US005868175A

United States Patent [19]

Duff et al.

[11] Patent Number: 5,868,175

[45] Date of Patent: Feb. 9, 1999

[54] APPARATUS FOR RECOVERY OF FUEL VAPOR

[75] Inventors: Richard L. Duff; Jim A. Beatty, both of Fort Wayne; Jason G. Awad, Bluffton, all of Ind.

[73] Assignee: Franklin Electric Co., Inc., Bluffton, Ind.

[21] Appl. No.: 674,606

[22] Filed: Jun. 28, 1996

[51] Int. Cl.[6] ..... B67D 5/06

[52] U.S. Cl. ..... 141/59; 141/83; 141/94; 141/192; 417/18; 417/32; 417/43; 417/44.11; 417/45; 417/360; 417/410.3; 417/422; 418/104; 418/259

[58] Field of Search ..... 141/7, 59, 83, 141/94, 192; 417/18, 32, 43, 45, 44.11, 360, 410.3, 422; 418/104, 259

[56] References Cited

U.S. PATENT DOCUMENTS

| | | | |
|---|---|---|---|
| Re. 35,238 | 5/1996 | Pope | 141/59 |
| 2,401,124 | 5/1946 | Walker et al. . | |
| 2,724,970 | 11/1955 | Risser | 73/244 |
| 2,910,003 | 10/1959 | Kaatz | 417/422 X |
| 3,016,928 | 1/1962 | Brandt | 141/45 |
| 3,498,501 | 3/1970 | Robbins et al. | 222/26 |
| 3,581,282 | 5/1971 | Altman | 340/149 |
| 3,605,824 | 9/1971 | Madden et al. | 141/1 |
| 3,756,291 | 9/1973 | McGahey et al. | 141/45 |
| 3,763,901 | 10/1973 | Viland | 141/8 |
| 3,791,422 | 2/1974 | Johnson | 141/11 |
| 3,814,934 | 6/1974 | Mesh | 250/231 |
| 3,815,327 | 6/1974 | Viland | 55/80 |
| 3,826,291 | 7/1974 | Steffens | 141/59 |

(List continued on next page.)

FOREIGN PATENT DOCUMENTS

| | | |
|---|---|---|
| 0 443 068 A1 | 8/1991 | European Pat. Off. . |
| 0 513 998 A1 | 11/1992 | European Pat. Off. . |
| 2 641 267 | 7/1990 | France . |
| 28 17 980 A1 | 11/1978 | Germany . |
| 87 17 378.6 | 10/1988 | Germany . |
| 39 03 603 A1 | 8/1990 | Germany . |
| 90 07 190.5 | 10/1990 | Germany . |
| 2 014 544 | 8/1979 | United Kingdom . |
| 2 206 561 | 1/1989 | United Kingdom . |
| 2 226 812 | 7/1990 | United Kingdom . |

OTHER PUBLICATIONS

Bergamini, G., "Nuovo Pignone Analysis", Feb. 28, 1989.

Gulf, (VCP System), Undated, 6 pages.

Hirt, Combustion Engineers, (VCS–200 Vapor Net), Jun. 1986, 6 pages.

Patent Application filed May 7, 1979 07/036,302 Walker, et al, abandoned file Incorporated by reference into U.S.P. 4,429,725; p. 7, line 36 to p. 8, line 9—may be pertinent.

*Primary Examiner*—J. Casimer Jacyna

*Attorney, Agent, or Firm*—Marshall, O'Toole, Gerstein, Murray & Borun

[57] ABSTRACT

This disclosure relates to a vapor recovery unit of a fuel dispenser, and comprises a vapor pump, a variable speed electric motor coupled to drive the pump, and an electric control package connected to control the speed of the motor, the foregoing components being located in an integrated unit housing. The pump comprises a positive displacement vapor pump such as a vane pump; the motor comprises a variable speed induction motor; and the control package is operable to receive fuel-flow representative pulses from one or two flow meters, and to vary the pump-motor speed to recover substantially all of the displaced vapor during fueling. The unit housing is preferably installed in a dispenser cabinet and hydraulically coupled in a vapor flow pipe and electrically connected to receive the fuel flow pulses from one or two fuel flow meters. The vapor recovery unit is useful as original equipment (OEM) and/or as a retrofit component. The control package is operable to adjust or modify the pump-motor speed to compensate for the vapor pump temperature and nonlinear operating characteristics. An improved calibration arrangement is provided, and an improved fault detection arrangement is provided. The unit also includes an improved arrangement for heating the pump-motor at low ambient temperatures.

25 Claims, 15 Drawing Sheets

U.S. PATENT DOCUMENTS

| | | | |
|---|---|---|---|
| 3,829,248 | 8/1974 | Bright et al. | 417/410 |
| 3,850,208 | 11/1974 | Hamilton | 141/59 |
| 3,874,427 | 4/1975 | Tiggelbeck | 141/52 |
| 3,881,894 | 5/1975 | Onufer | 55/88 |
| 3,899,009 | 8/1975 | Taylor | 141/59 |
| 3,905,405 | 9/1975 | Fowler et al. | 141/46 |
| 3,913,633 | 10/1975 | Hiller | 141/45 |
| 3,913,787 | 10/1975 | Dilger | 222/26 |
| 3,915,206 | 10/1975 | Fowler et al. | 141/59 |
| 3,926,230 | 12/1975 | Stary et al. | 141/45 |
| 3,941,168 | 3/1976 | Hiller et al. | 141/46 |
| 3,952,781 | 4/1976 | Hiller et al. | 141/46 |
| 3,981,334 | 9/1976 | Deters | 141/46 |
| 4,009,985 | 3/1977 | Hirt | 431/5 |
| 4,020,861 | 5/1977 | Shihabi | 137/100 |
| 4,047,548 | 9/1977 | Wagner | 141/52 |
| 4,051,998 | 10/1977 | Zabel | 364/465 |
| 4,056,131 | 11/1977 | Healy | 141/206 |
| 4,057,085 | 11/1977 | Shihabi | 141/59 |
| 4,057,086 | 11/1977 | Healy | 141/206 |
| 4,058,147 | 11/1977 | Stary et al. | 141/45 |
| 4,063,874 | 12/1977 | Stary et al. | 431/350 |
| 4,068,687 | 1/1978 | Long | 141/59 |
| 4,072,934 | 2/1978 | Hiller | 340/243 |
| 4,082,122 | 4/1978 | McGahey | 141/5 |
| 4,095,626 | 6/1978 | Healy | 141/206 |
| 4,118,170 | 10/1978 | Hirt | 431/5 |
| 4,153,073 | 5/1979 | Deters | 137/493.4 |
| 4,166,485 | 9/1979 | Wokas | 141/52 |
| 4,167,958 | 9/1979 | Voelz | 141/95 |
| 4,197,883 | 4/1980 | Mayer | 141/59 |
| 4,199,012 | 4/1980 | Lasater | 141/52 |
| 4,202,385 | 5/1980 | Voelz et al. | 141/59 |
| 4,223,706 | 9/1980 | McGahey | 141/59 |
| 4,253,503 | 3/1981 | Gunn | 141/59 |
| 4,256,151 | 3/1981 | Gunn | 141/59 |
| 4,260,000 | 4/1981 | McGahey et al. | 141/59 |
| 4,273,164 | 6/1981 | Gunn | 141/7 |
| 4,292,020 | 9/1981 | Hirt | 431/5 |
| 4,295,505 | 10/1981 | Hasselmann et al. | 141/301 |
| 4,306,594 | 12/1981 | Planck | 141/59 |
| 4,310,033 | 1/1982 | Deters | 141/44 |
| 4,336,830 | 6/1982 | Healy | 141/59 |
| 4,429,725 | 2/1984 | Walker et al. | 141/59 |
| 4,522,237 | 6/1985 | Endo et al. | 141/95 |
| 4,566,504 | 1/1986 | Furrow et al. | 141/59 |
| 4,606,707 | 8/1986 | Kumata | 417/410.3 X |
| 4,649,970 | 3/1987 | Bower et al. | 141/302 |
| 4,662,539 | 5/1987 | Komukai | 222/14 |
| 4,680,004 | 7/1987 | Hirt | 431/5 |
| 4,687,033 | 8/1987 | Furrow et al. | 141/59 |
| 4,749,009 | 6/1988 | Faeth | 141/45 |
| 4,790,349 | 12/1988 | Harris | 137/587 |
| 5,005,613 | 4/1991 | Stanley | 141/45 |
| 5,029,622 | 7/1991 | Mutter | 141/94 X |
| 5,038,838 | 8/1991 | Bergamini et al. | 141/59 |
| 5,040,577 | 8/1991 | Pope | 141/59 |
| 5,040,950 | 8/1991 | Dalquist, III et al. | 417/422 X |
| 5,123,817 | 6/1992 | Willemson | 417/404 |
| 5,141,402 | 8/1992 | Bloomquist et al. | 417/45 X |
| 5,151,111 | 9/1992 | Tee et al. | 55/164 |
| 5,156,199 | 10/1992 | Hartsell, Jr. et al. | 141/83 |
| 5,158,436 | 10/1992 | Jensen et al. | 417/32 |
| 5,195,564 | 3/1993 | Spalding | 141/1 |
| 5,197,523 | 3/1993 | Fink, Jr. et al. | 141/206 |
| 5,234,319 | 8/1993 | Wilder | 417/45 X |
| 5,269,353 | 12/1993 | Nanaji et al. | 141/59 |
| 5,280,814 | 1/1994 | Stroh | 141/83 |
| 5,299,605 | 4/1994 | Bergamini et al. | 141/59 |
| 5,301,721 | 4/1994 | Hartmann | 141/59 |
| 5,323,817 | 6/1994 | Spalding | 141/1 |
| 5,325,896 | 7/1994 | Koch et al. | 141/59 |
| 5,332,008 | 7/1994 | Todd et al. | 141/5 |
| 5,332,011 | 7/1994 | Spalding | 141/59 |
| 5,333,655 | 8/1994 | Bergamini et al. | 141/59 |
| 5,345,979 | 9/1994 | Tucker et al. | 141/1 |
| 5,355,915 | 10/1994 | Payne | 141/83 |
| 5,360,322 | 11/1994 | Henein et al. | 417/313 |
| 5,507,326 | 4/1996 | Cadman et al. | 141/59 X |
| 5,591,019 | 1/1997 | Brown | 417/422 |

40
38
42
43
39
103
98
DC to 3ø AC
99
SPEED CONTROL CIRCUIT
91A
91
96A
101
102
97
AC to DC
96
96A
14'
30'
FUEL FLOW TRANS
92A
9A
90
92
FLOW SIGNAL GEN.
30B
14
30
30A
FUEL FLOW TRANSDUCER

APPARATUS FOR RECOVERY OF FUEL VAPOR

FIELD AND BACKGROUND OF THE INVENTION

This invention relates generally to apparatus for use in a fuel vapor recovery system.

A fuel delivery system of an automotive service or filling station normally includes a number of large fuel storage containers (usually located below ground surface level), one or more fuel dispensers installed at the surface, pipes or conduits connecting the storage containers with the dispensers, and a fuel supply pump-motor for pumping fuel through the pipes from the containers to the dispensers. Such a system normally also includes a leak detector and valves connected in the pipes, and a fuel flow meter mounted in the dispenser cabinet. As described in numerous prior art patents, such as the Bergamini U.S. Pat. No. 5,038,838 and the Pope U.S. Pat. No. 5,355,925, the fuel flow meter generates a series of pulses which are proportioned to the quantity of fuel delivered, and a microprocessor computes and displays the total fuel quantity and price.

In recent years, primarily in response to federal and state regulations, vapor recovery systems are being added to the fuel delivery systems as described above. When fuel is pumped from a supply container into a receiving container, fuel vapor in the receiving container is displaced by the fuel, and, in earlier systems, the displaced vapor was allowed to escape into the environment. However, in a typical vapor recovery system, the vapor is pumped from the receiving container to the supply container. As examples, vapor from an underground storage container is pumped into the tank truck, and vapor from an automotive fuel tank is pumped into the underground storage container. The vapor pump is responsive to the volume of fuel being pumped into the receiving container such that substantially all of the displaced fuel vapor is recovered.

It is a general object of the present invention to provide an improved vapor recovery unit for use in a vapor recovery system as described above.

SUMMARY OF THE INVENTION

A vapor recovery unit constructed in accordance with the present invention comprises a vapor pump, a variable speed electric motor coupled to drive the pump, and an electric control package connected to control the speed of the motor, the foregoing components being located in an integrated unit housing. The pump comprises a positive displacement vapor pump such as a vane pump; the motor comprises a variable speed induction motor; and the control package is operable to receive fuel-flow representative pulses from one or two flow meters, and to vary the pump-motor speed to recover substantially all of the displaced vapor during fueling. The unit housing is preferably installed in a dispenser cabinet and hydraulically coupled in a vapor flow pipe and electrically connected to receive the fuel flow pulses from one or two fuel flow meters. The vapor recovery unit is useful as original equipment (OEM) and/or as a retrofit component. The control package is operable to adjust or modify the pump-motor speed to compensate for the vapor pump temperature and nonlinear operating characteristics. An improved calibration arrangement is provided, and an improved fault detection arrangement is provided. The unit also includes an improved arrangement for heating the pump-motor at low ambient temperatures.

BRIEF DESCRIPTION OF THE DRAWINGS

The invention will be better understood from the following detailed description taken in conjunction with the accompanying figures of the drawings, wherein.

DETAILED DESCRIPTION OF THE INVENTION

Figure 1:
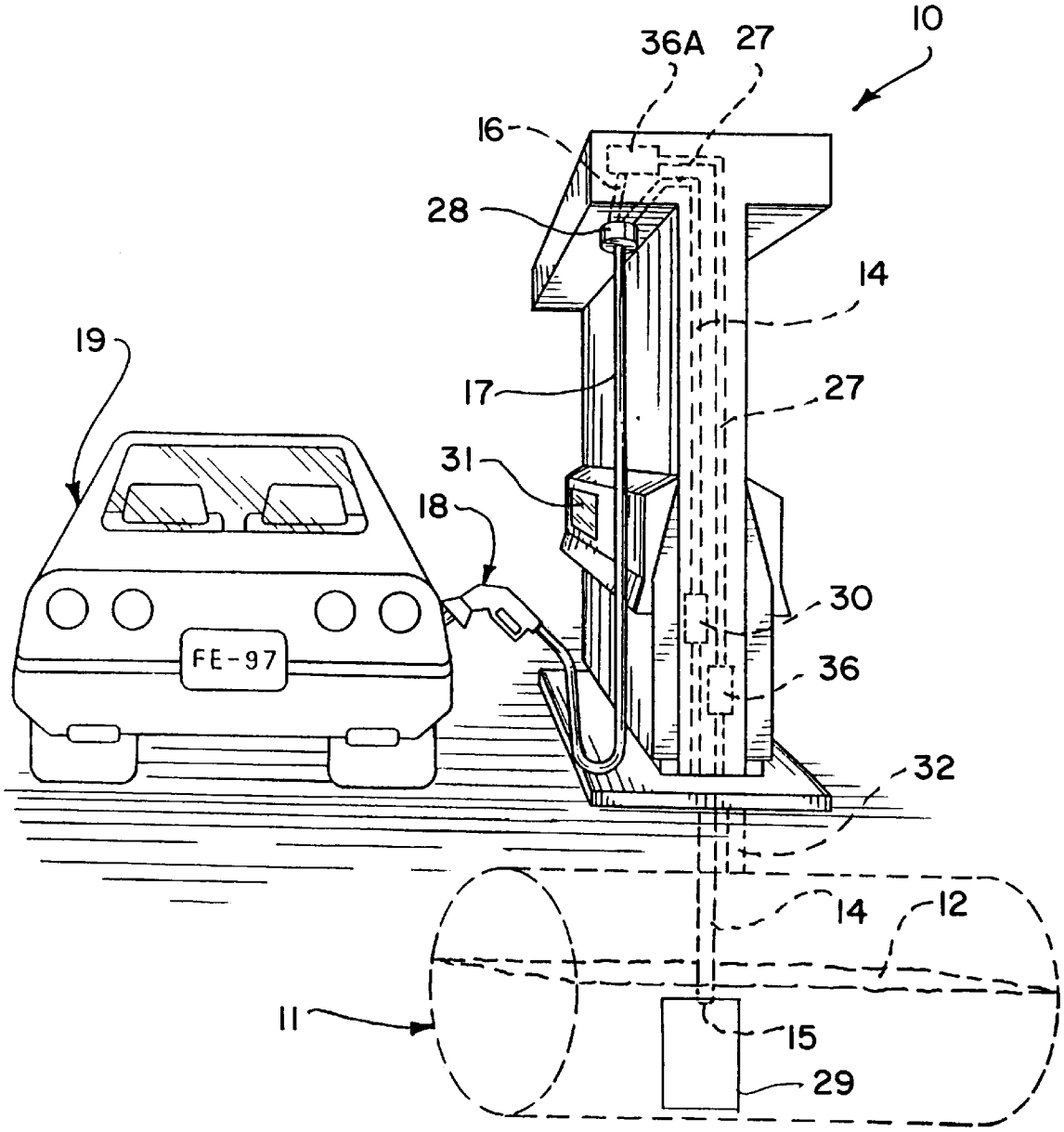
FIG. 1 is a perspective view of part of a fuel dispensing system including a vapor recovery unit in accordance with this invention.

With reference first to FIG. 1, a fuel dispenser island or cabinet 10 is shown, in this instance having identical fuel dispensers on opposite sides. A fuel storage container 11 (in this instance it is underground) is partially filled with fuel 12, leaving an open space or volume 13 above the fuel which is filled with fuel vapor and/or air. A fuel delivery pipe 14 has one end 15 extending into the fuel 12 and a second end 16 which is coupled, to a flexible fuel delivery hose 17. A nozzle 18 (FIGS. 1 and 2) is attached to the outer end of the hose 17, the nozzle 18 being inserted into the fuel filling pipe (not illustrated) of an automobile 19. The filing pipe, of course, is attached to the fuel tank (not illustrated) of the automobile 19.

Figure 2:
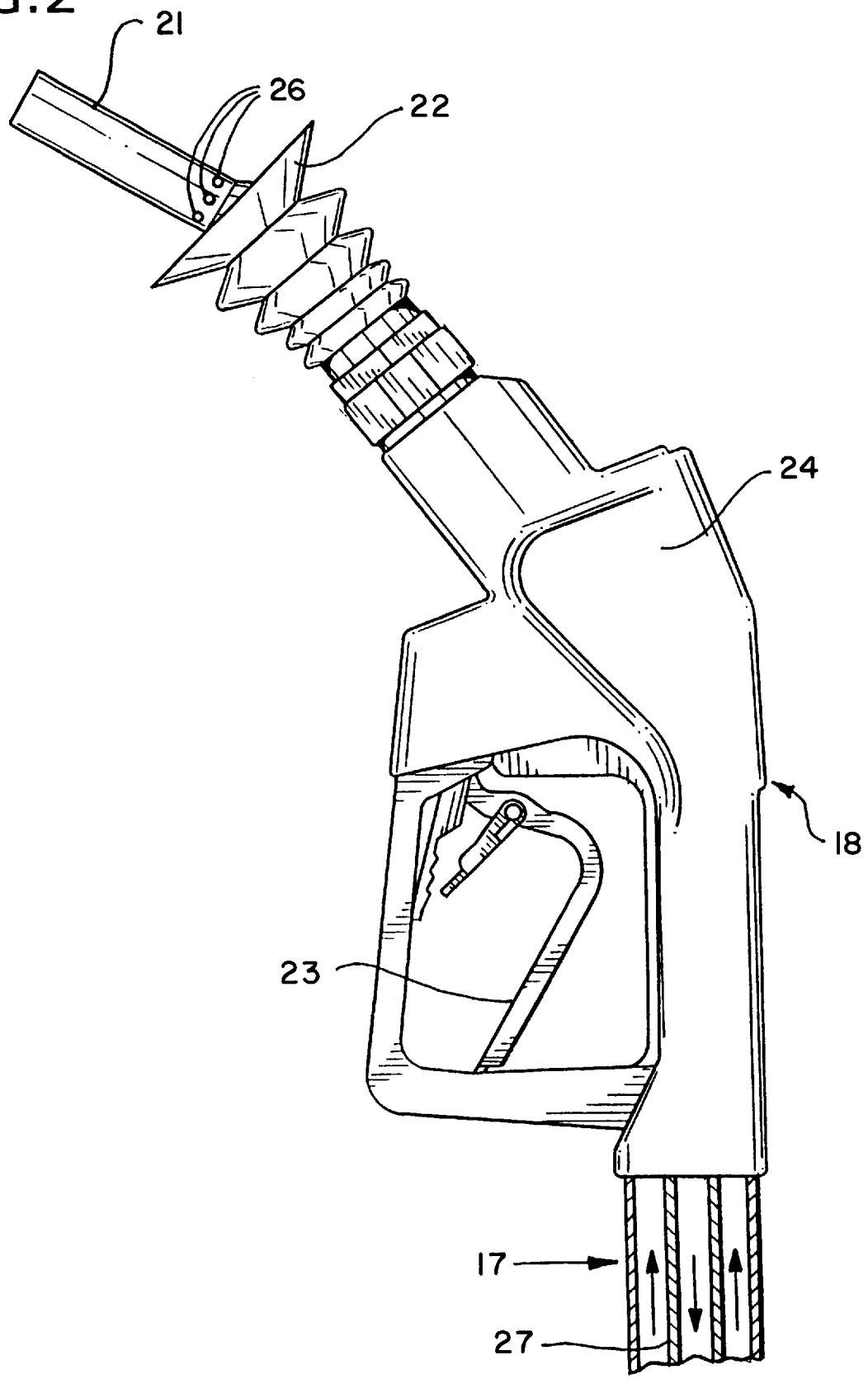
FIG. 2 is an illustration of a fuel delivery nozzle of the dispensing system.

With reference to FIG. 2, the nozzle 18 includes a fuel tube 21 sized to fit into the fuel filling pipe, and in the specific example shown and described, a pliable splash guard 22 partially encloses the tube 21. A hand-operated lever 23 is pivotably mounted on the nozzle housing 24. When the hand-operated lever 23 is squeezed, a valve (not shown) in the housing 24, is opened and fuel flows from the hose 17, through the tube 21 and into the automobile's fuel tank. When the nozzle valve is closed to stop fuel flow, a vapor recovery unit to be described hereinafter is also turned off in order to stop the vapor flow.

To recover the vapor displaced by the fuel, holes 26 are formed in the tube 21 and a vapor tube (not illustrated) extends from the holes 26 to a vapor return tube 27. In the present example, the vapor return tube 27 extends through the interior of the fuel delivery hose 17. With reference again to FIG. 1, the tube 27 separates from the hose 17 at a coupling 28 in the dispenser 10. It should be understood that the structure described thus far is by way of a specific example and that other variations are known in the prior art.

In FIG. 1, a conventional fuel pump-motor unit 29 is provided to pump fuel 12 from the container 11, through the pipes 14 and 17 to the nozzle 18, and a conventional control system is provided for the fuel pump-motor unit 29. The pump-motor unit 29 may be located within the fuel 12 in the container 11 or outside the fuel and function as a suction pump. A fuel flow transducer 30 is connected in the pipes 14; the transducer 30 is a conventional type well known to those skilled in this art, which, during the flow of fuel, delivers a train or series of electrical pulses, the number of pulses being directly proportional to the quantity or volume of fuel that is delivered to the automobile fuel tank. The electrical pulses are connected to a conventional microprocessor which calculates the total cost and quantity of the fuel and displays these values on a screen 31 of the dispenser. The pulses are also normally delivered to a central monitor of the station.

The vapor return tube 27 is connected to a pipe 32 (FIG. 1) which leads to the space 13 in the supply container 11, and a vapor recovery unit 36 is connected in the return tube 27 within the dispenser cabinet 10. The numeral 36 indicates a lower location of the vapor recovery unit, and the numeral 36A illustrates an alternative upper location of the unit. It is a feature of the present invention that the unit 36 may be connected in the vapor return tube 27 at most any convenient location for installation and maintenance but preferably resides within the cabinet 10. Further, the unit 36 may form part of the original equipment (OEM) or it may be a field retrofit. The unit 36 is hydraulically coupled to the vapor return tube 27, it is electrically connected to receive the fuel flow volume representative signal from the flow transducer 30, and it is electrically connected to an electrical power supply for powering the vapor pump-motor of the unit 36.

Figure 3:
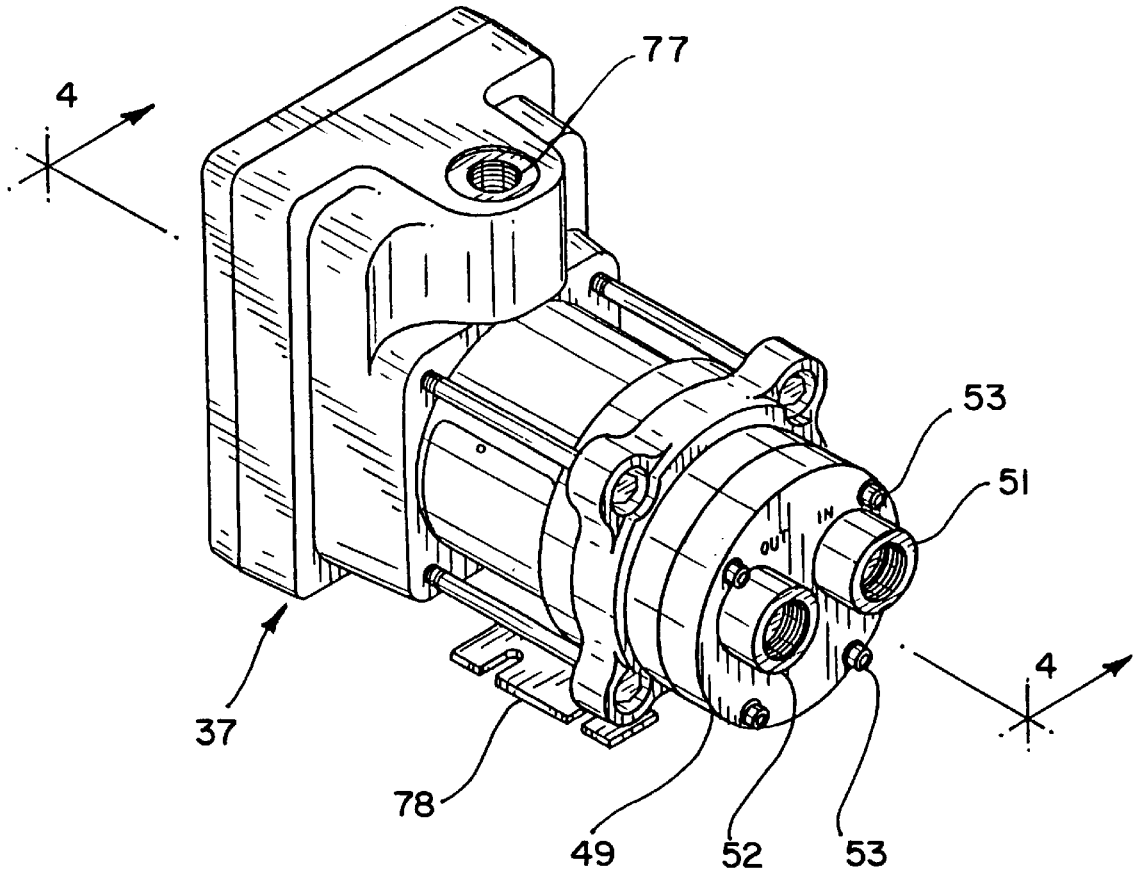
FIG. 3 is a perspective view of the vapor recovery unit.
Figure 4:
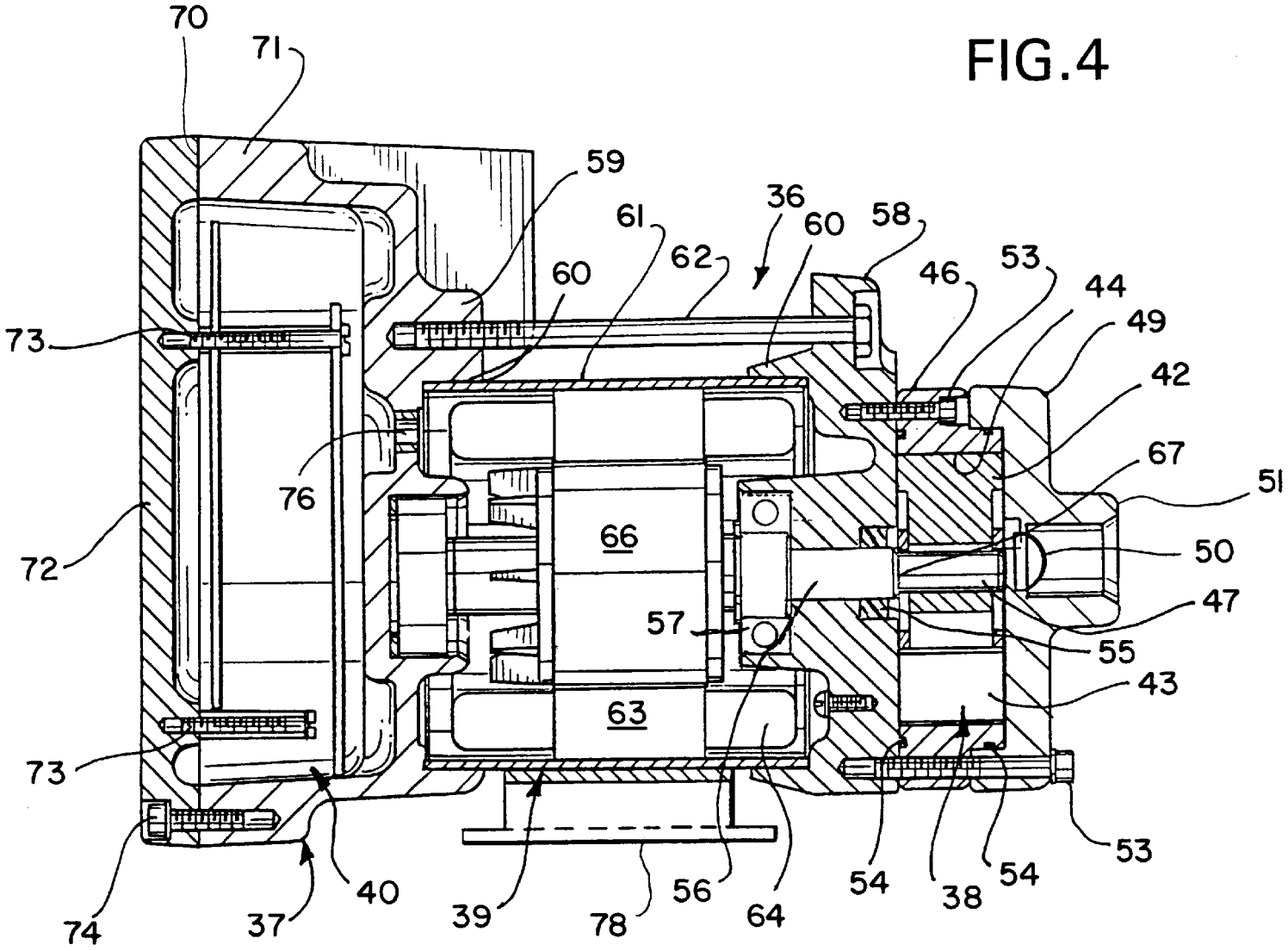
FIG. 4 is a sectional view taken on the line 4—4 of FIG. 3.
Figure 5:
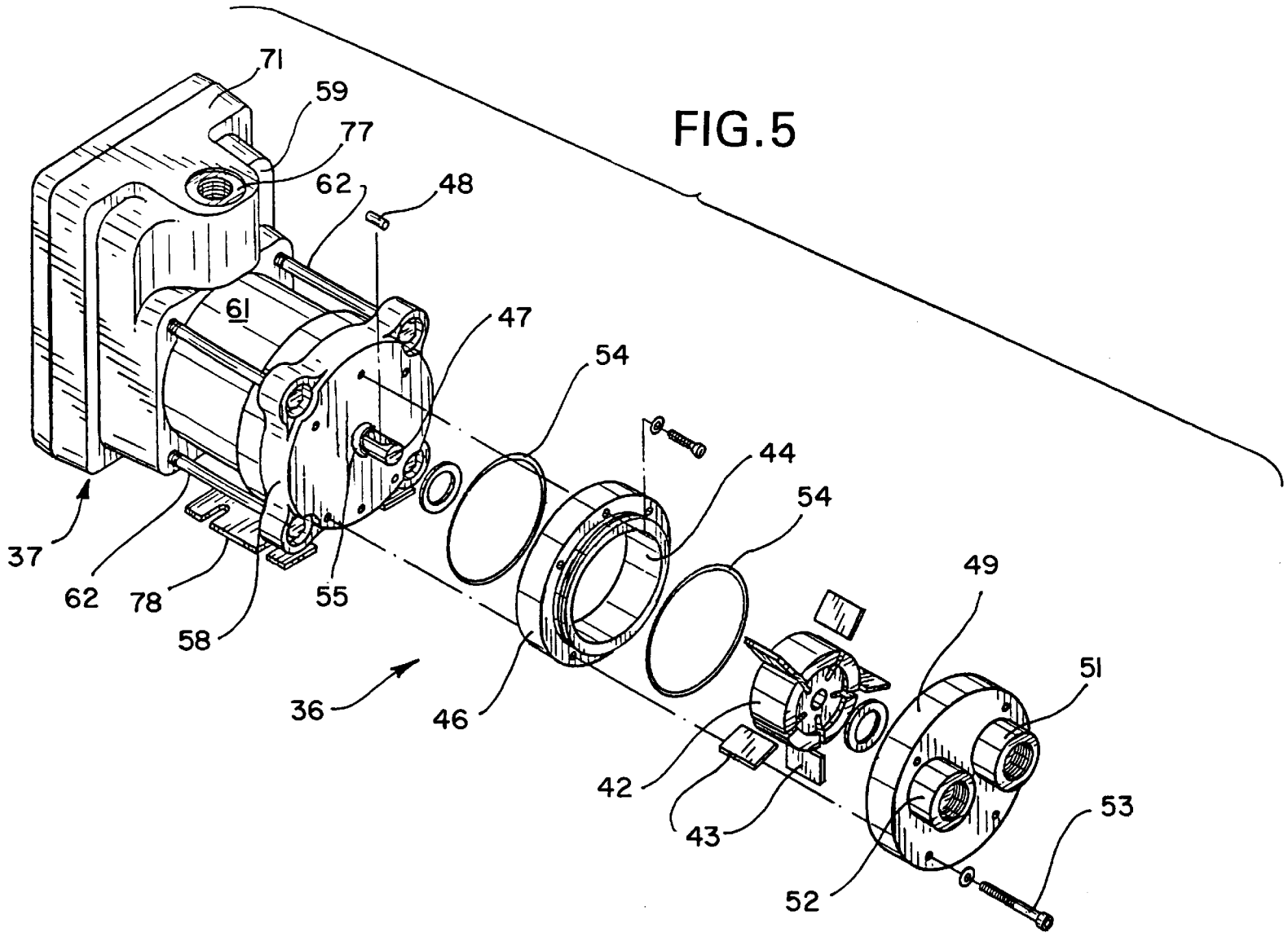
FIG. 5 is a partially exploded view, in perspective, of the vapor recovery unit, illustrating the vapor pump.
Figure 9:
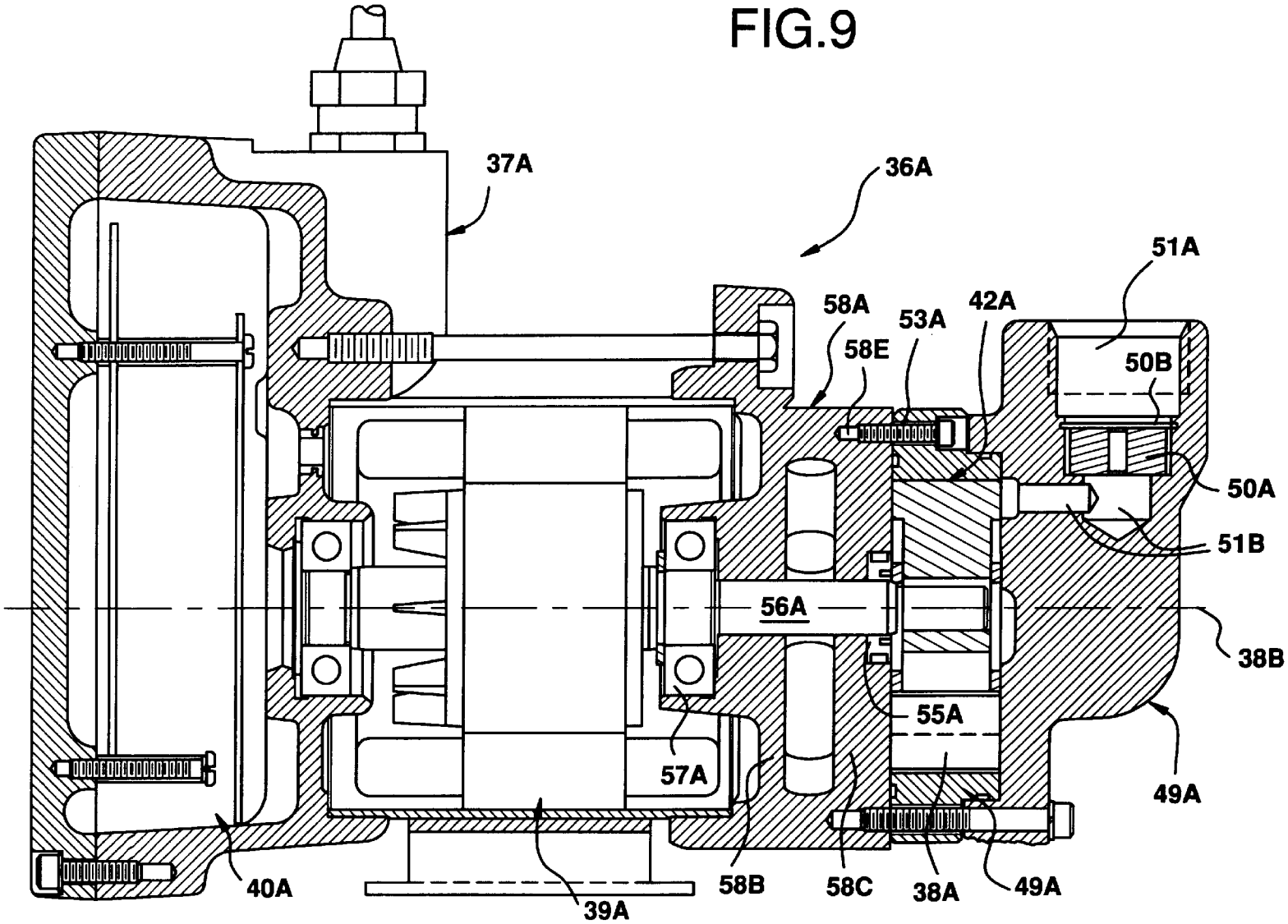
FIG. 9 is a view similar to FIG. 4 and shows an alternative embodiment of the vapor recovery unit.
Figure 10:
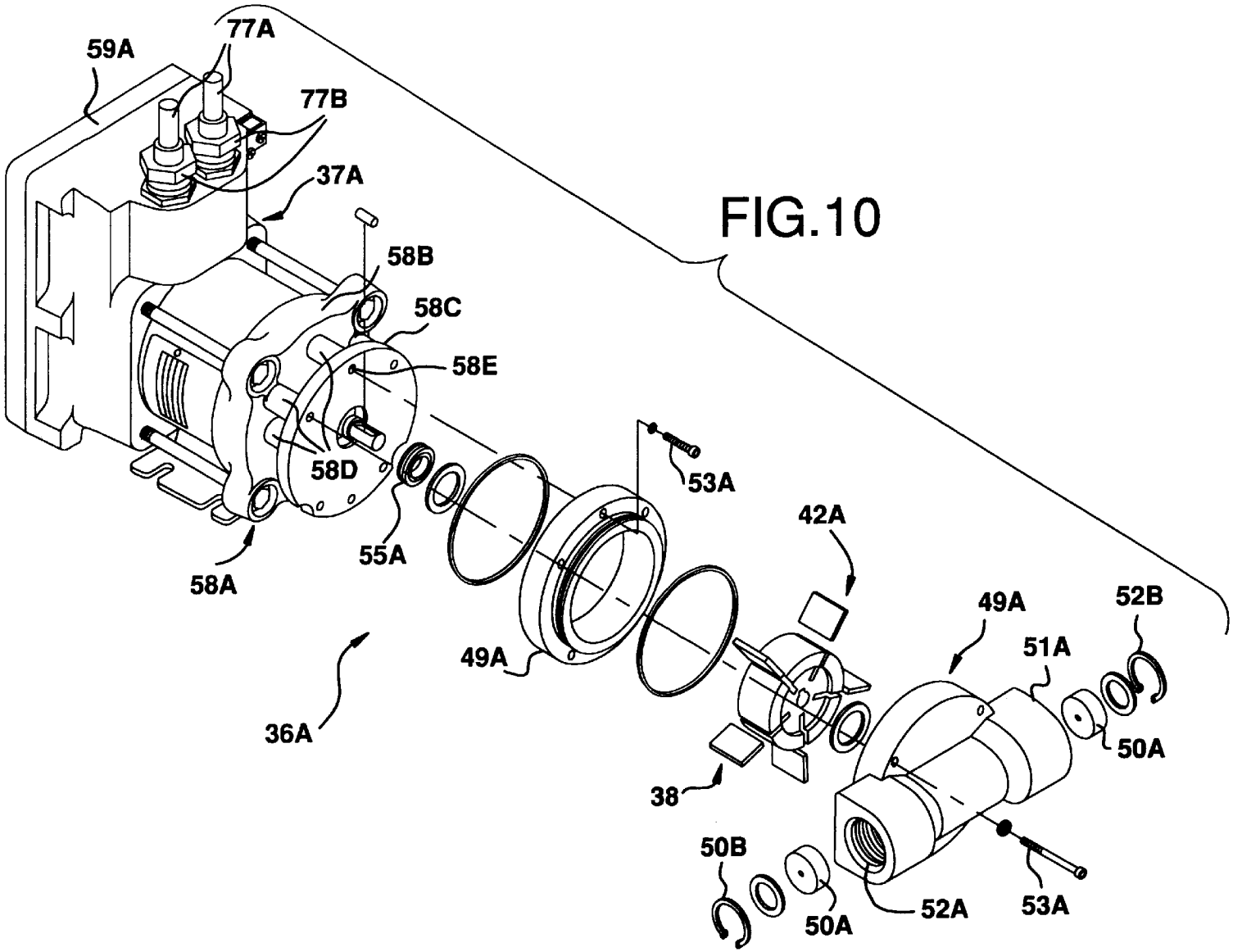
FIG. 10 is a view similar to FIG. 5 and shows the embodiment of FIG. 9.

FIGS. 3, 4 and 5 show one embodiment of the unit 36, and FIGS. 9 and 10 show an alternative embodiment.

With reference to FIGS. 3, 4 and 5, the unit 36 comprises a sealed explosion proof unit housing 37 which encloses a vapor pump 38, a variable speed electric motor 39, and an electrical control package 40. The parts forming the housing are sufficiently strong to withstand an internal explosion without rupturing, if one should occur.

The vapor pump 38 in the specific example described and illustrated herein, is a positive displacement vane pump which is capable of pumping vapor and any liquid fuel entrained with the vapor. As a specific example, it is capable of developing a pressure of 22" Hg and it has a variable flow rate of 0–14 gpm. It includes a rotor 42 which supports a plurality of radially movable vanes 43. The rotor 42 and the vanes 43 are rotatable in a pump cavity 44 of a pump housing 46, and the rotor 42 is secured to a drive shaft 47 by a key 48 (FIG. 5). A pump cover 49 extends over the front side (toward the right as seen in FIG. 4) of the pump housing 46, and the cover 49 has a vapor intake opening and coupling 51 and a vapor outlet opening and coupling 52 formed on it. Screws 53 secure the cover 49 to the pump housing 46. The intake coupling 51 is connected to the portion of the vapor return tube 27 which leads to the nozzle 18, and the outlet coupling 52 is connected to the portion of the vapor return tubes 27 and 32 which lead to the storage container 11. A filter screen 50 is preferably provided across the-opening of the intake coupling 51. When the rotor 42 and the vanes 43 turn in the cavity 44, fuel vapor is pumped from the intake coupling 51 to the outlet coupling 52. O-ring seals 54 are provided on opposite sides of the housing 46 to seal and prevent vapor leakage from the cavity 44.

The drive shaft 47 is an extension of the rotor shaft 56 of the motor 39. The rotor shaft 56 is supported by ball bearings 57 in motor end frames 58 and 59, and a shaft seal 55 is provided between the end frame 58 and the shaft 56. A tubular motor shell 61 extends between the end frames 58 and 59, and four bolts 62 secure the end frames and the shell together. Stator laminations 63 and stator windings 64 are secured to the interior of the shell 61. The motor 39 is preferably an induction motor type having a power rating of, for example, ⅛ Hp. A squirrel-cage rotor 66 is mounted on the rotor shaft 56 and rotates in the rotor cavity formed within the stator laminations 63. The previously mentioned screws 53 secure the pump 38 to the front side of the end frame 58.

It will be noted from FIGS. 4 and 5 that the end frame 58 forms an imperforate (except for the opening 67 for the drive shaft 47) shield or separator between the pump cavity 44 and the interior of the motor. The seal 55 is provided to prevent vapor flow between the shaft 47 and the opening 67. Consequently, the motor 39 is sealed from the pump 38 even though they are contained adjacent each other in the unit housing 37, thereby preventing any motor sparks or discharges from reaching the fuel vapor in the pump 38. Further, the portions 60 of the end frames 58 and 59 tightly overlap the exterior end portions of the shell 61, and thus form a relatively long flame-proof joint, which prevents any interior flame from escaping the interior of the housing 37.

The motor end frame 59 forms an extension 71 which houses the control package 40. The extension 71 projects toward the back side (toward the left as seen in FIG. 4) of the unit, and a cover 72 extends over the opening formed by the extension 71. Screws 73 secure the control package 40 to the cover 72, and a plurality of screws 74 secure the cover 72 to the extension 71. A hole 76 is formed through the end frame 59 for the passage of electric wires (not illustrated) connecting the control package 40 to the motor 39. With reference to FIG. 5, an internally threaded hole 77 is formed through the end frame 59 and is located to enable electric wires to extend through the unit housing 37 to the control package 40. As will be described in connection with FIGS. 6 and 7, there are a number of electrical connections to the control package. The hole 77 is sealed around the wires (as by an epoxy compound), and the joint 70 between the extension 71 and the cover 72 is relatively tight and long and forms a flame-proof path.

To install the unit 36 within the dispenser cabinet 10, a mounting bracket 78 is provided, and in the present specific example of the invention, the bracket 78 is secured to one side of the motor shell 61.

The vapor recovery unit 36 thus forms an integrated system wherein all components are contained in a single explosion-proof housing. The unit is therefore relatively easy to install and maintain because it may be located at various positions in a dispenser. This is in contrast to prior art vapor recovery systems wherein the electrical power and controls are remote from the motor and the pump. The unit preferably includes a squirrel-cage induction motor which has proven reliability and is cost effective, but a similar suitable motor may be used.

FIGS. 9 and 10 show a unit 36A which is similar to that of FIGS. 3 to 5 but is structured for a different market such as European installations. For corresponding parts, the reference numerals in FIGS. 9 and 10 are the same as those used in FIGS. 4 and 5 but with the addition of the letter A. Only the parts in FIGS. 9 and 10 which differ from those in FIGS. 4 and 5 are described in detail.

The unit 36A shown in FIGS. 9 and 10 includes a unit housing 37A, a vane pump 38A, a variable speed motor 39A and a control package 40A. The pump cover 49A includes a vapor intake opening 51A and a vapor outlet opening 52A, and a filter 50A is secured by a split ring 50B in each of the openings 51A and 52A. As best shown in FIG. 10, the openings 51A and 52A are substantially aligned on an axis which is perpendicular to the rotational axis 38B of the pump rotor 42A. Both of the openings 51A and 52A include flow passages (see the passages 51B in FIG. 9) which extend to the forward side of the rotor cavity.

The motor end frame 58A includes two plate portions 58B and 58C which are connected by a plurality of spaced apart joining portions 58D. The bolt holes 58E for the bolts 53A are preferably aligned with the joining portions 58D. The plate portion 58B supports the ball bearing 57A and the plate portion 58C supports the rotary seal 55A. The plate portions 58B and 58C are separated but connected by the joining portions 58D.

While the unit shown in FIG. 5 includes a single opening 77 for conductors leading to the control package 40, the end frame 59A (FIG. 10) has two such openings, and cables 77A extend through the openings and are secured by couplings 77B to the end frame 59A. For example, one of the cables may comprise power conductors and the other may comprise conductors carrying control signals.

Figure 6:
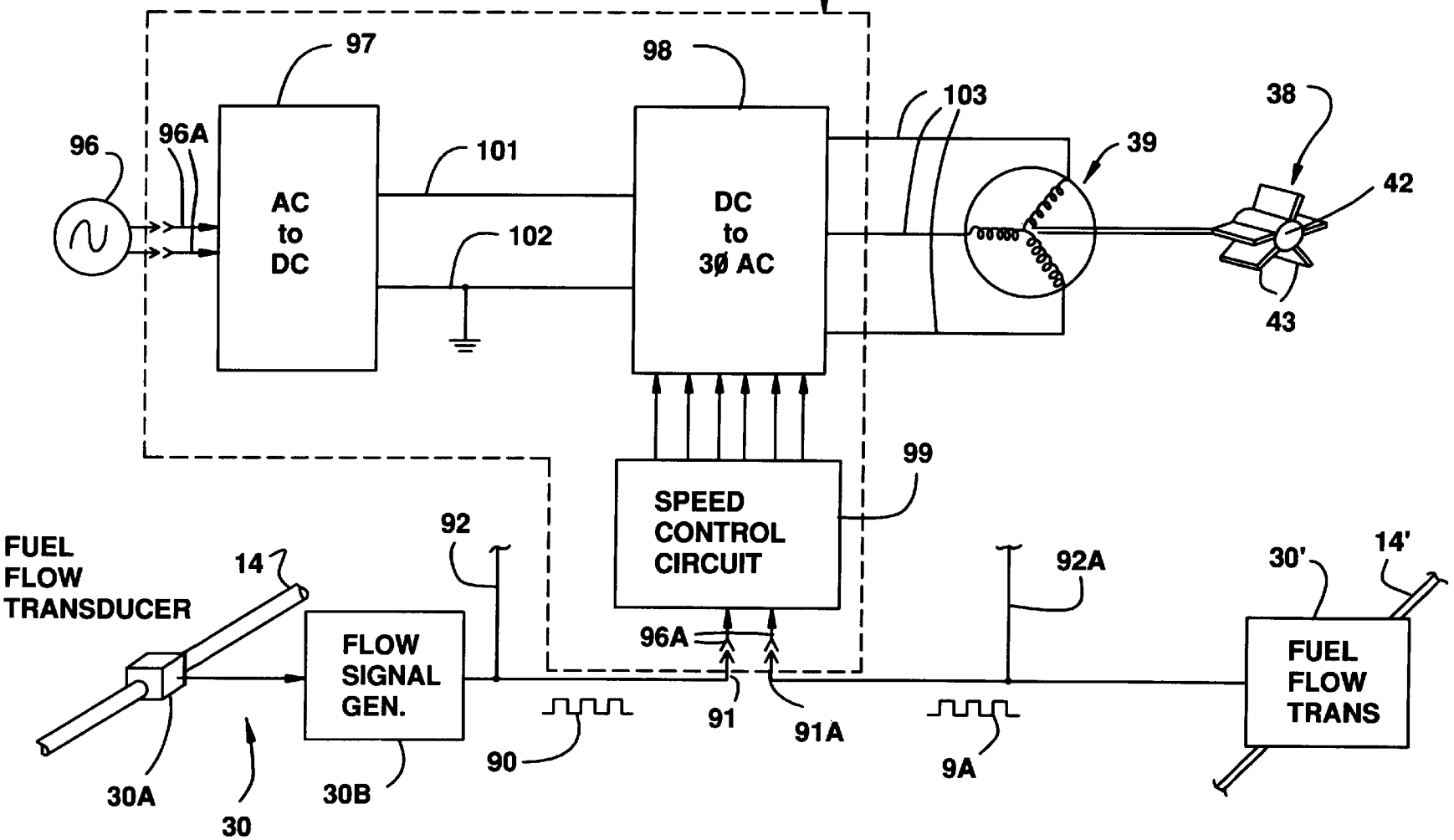
FIG. 6 is an electrical block diagram illustrating the control package.

FIG. 6 is a block diagram illustrating the unit. The fuel flow transducer 30 includes a meter 30A connected in the fuel pipe 14 (see also FIG. 1) and a pulse generator 30B which is coupled to the meter 30A and generates a series of electrical pulses 90 while fuel is flowing in the pipe 14 and the hose 17, the number of pulses 90 being directly proportional to the volume of fuel. FIG. 1 illustrates a dispenser 10 design including only a single hose 17 and nozzle 18 for ease of describing the present invention, but as is well known, many gasoline dispensers in present day use have multiple hoses and nozzles for dispensing various grades of gasoline. In a first type of system, three supply pipes 14 and flow transducers 30 are provided, one for each grade (usually a low grade, an intermediate grade and a high grade). Since only one hose and nozzle 18 may be in use at one time, only a single train of pulses 90 is received by the control package 40 at one time.

In a second type of system, two fuel supply pipes 14 and 14' (FIG. 6) and flow transducers 30 and 30' are provided, one for the low grade and one for the high grade. When the intermediate grade fuel is ordered, fuel from the low and high grade supply pipes 14 are blended to produce the intermediate grade, and in this situation, two trains of pulses 90 and 90*a* (FIG. 6) are simultaneously generated and fed to the control package 40. FIG. 6 illustrates the second pipe 14' and fuel flow meter 30'. Consequently in the second type of system, the control package 40 receives the two trains of pulses 90 and 90A simultaneously while the intermediate fuel grade is being dispensed, or it receives either the pulses 90 alone or the pulses 90A alone, depending on whether the low grade or the high grade fuel is being dispensed.

The pulses 90 and 90A are connected by lines 91 and 91A to the control package 40, and by lines 92 and 92A to a conventional microprocessor (not illustrated) of the dispenser, which computes total volume and cost figures.

The control package 40 is connectable to receive the fuel quantity representative pulses 90 (and/or the pulses 90A), and it is connectable to receive electrical power from a conventional supply 96 (FIG. 6). In the present example, the supply 96 is a single phase 120 volt AC supply. Terminals 96A are provided for connecting the lines 91 and 91A and the supply 96 to the control package 40. The power lines from the supply 96, and the lines 91 and 91A from the pulse generators, extend through the opening 77 in the unit housing. A DC link arrangement is provided for powering the variable speed induction motor 39, the link including an AC to DC converter 97, and connected to it a DC to AC inverter 98, and a motor speed control circuit 99. The converter 97 produces a DC link voltage on the lines 101 and 102, and the inverter 98 produces a three phase drive voltage on lines 103 which powers the motor 39. As will be described later in more detail, the speed control circuit 99 responds to the pulses 90 (and/or 90A) and adjusts the drive voltage. The motor and pumping speed are proportional to the fuel flow rate and the speed varies automatically with the fuel flow rate, to produce a motor 39 and pump 38 speed such that the volume of fuel vapor being pumped is related to the volume of fuel being delivered such as to meet the federal and state regulations. At the present time, the federal regulations require that the amount of vapor recovered from the automotive fuel tank be within ±5% of the amount of fuel pumped into the tank.

Figure 7:
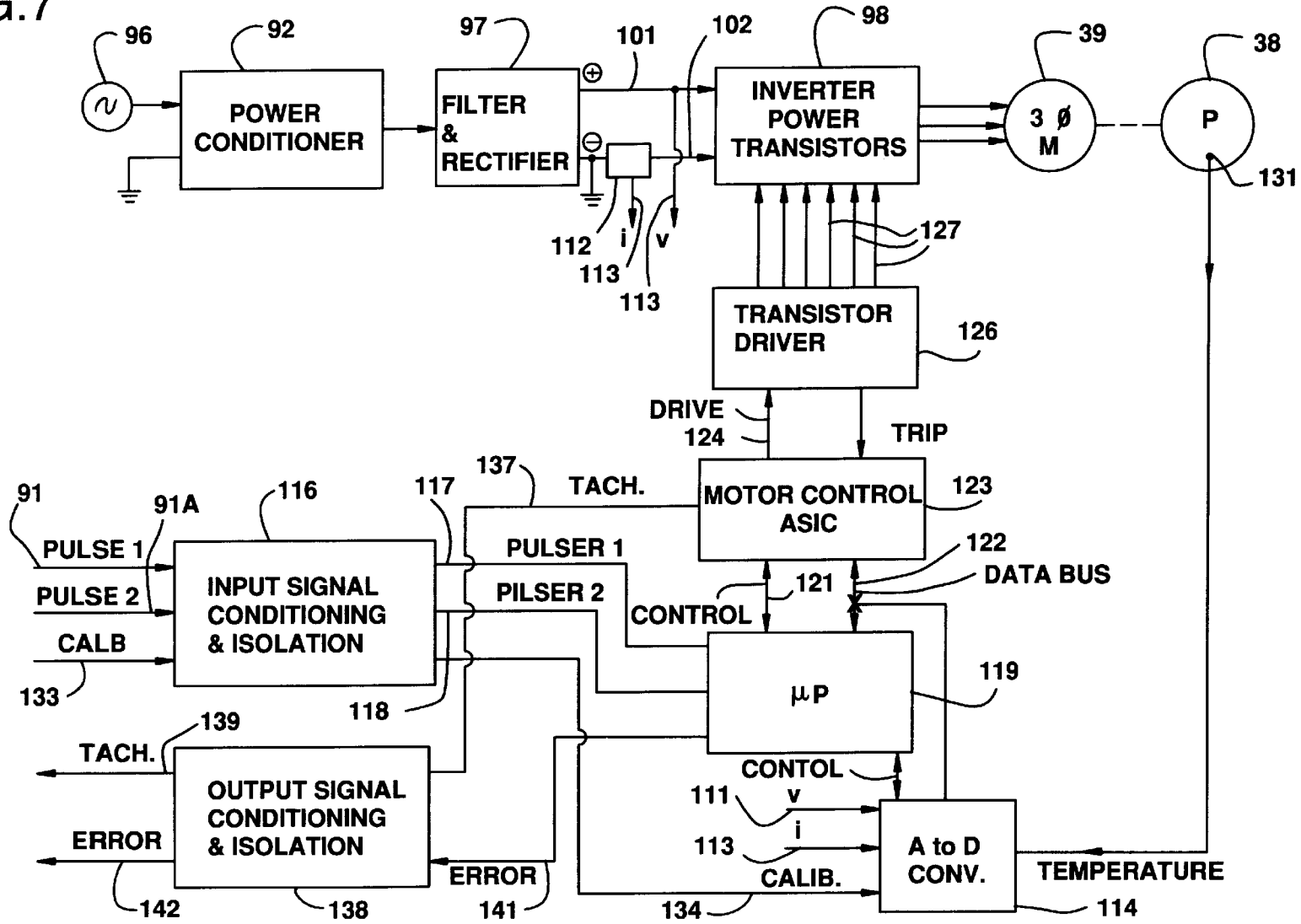
FIG. 7 is a more detailed electrical block diagram of the control package.

FIG. 7 is a block diagram showing in more detail a specific example of the DC link and the control circuit 99. The AC to DC rectifier 97 further includes a filter, and an input power conditioner 97A is preferably connected between the AC supply 96 and the rectifier 97. The DC link voltage on the line 101 is sensed and a voltage-representative signal appears on a line 111; a current sensor 112 is connected in the line 102, and a current-representative signal appears on a line 113. These two signals are fed to an analog-to-digital converter 114 which converts them to digital words. The components 98, 39 and 38 are connected as shown and described in connection with FIG. 6.

The speed control circuit 99 (FIGS. 6 and 7) includes an input signal conditioning and isolation circuit 116 which receives the fuel flow rate representative signal(s) (the pulses 90 and 90A) on the lines 91 and 91A and passes conditioned signals on lines 117 and 118 to a microprocessor ($\mu$p) 119. The $\mu$p 119 is connected by control signal lines 121 and by a data bus 122 to a motor control ASIC (application specific integrated circuit) 123 which generates and sends drive control signals on path 124 to power transistor gate drivers 126. The drivers, in turn, are connected by lines 127 to control six power transistors in the inverter 98.

A temperature sensor 131 is preferably mounted in the pump 38 (a thermistor is preferably mounted in the pump housing), and an analog signal representative of the temperature of the pump 38 is passed on a line 132 to the converter 114, which changes it to a digital word. It is also preferred that means be provided to calibrate the circuit to produce the desired vapor flow rate vs. fuel flow rate, as will be further described hereinafter. The conditioning circuit 116 receives a calibration signal on a line 133 and delivers a calibration signal on a line 134 to the converter 114 which changes it to a digital word.

It is still further preferred that the control package produce signals that are of use outside the unit. In this specific example, a motor speed representative signal produced by the circuit 123 is fed on a line 137 to a circuit 138 which conditions and isolates the speed output signal which appears on a line 139. An error signal produced by the $\mu$p 119 on a line 141 is fed to the circuit 138. An error signal on an output line 142 provides an indication of an abnormal operating condition, as will be described.

The following discussed functions will be further discussed in connection with the flow chart of FIGS. 8A to 8E.

As previously mentioned, the speed control circuit 99 has the capability of responding to a signal from one fuel flow meter or from two fuel flow meters, simultaneously. The latter function is important in situations wherein two grades of fuel are blended to create another grade of fuel, and the two grades of fuel pass through different flow meters. The pulse rates from the two meters vary in frequency as the fuel flow rates vary, and the frequencies may be different. The signal on each of the two lines 117 and 118 comprises pulses, and the two pulse signals are added in the processor 119, and the total is employed to control the speed of the motor 39. While the flow rate representative signals have been described as series of pulses, the signals could take other forms, such as pulse-width-modulated signals or analog voltages, which could be successfully interpreted by the microprocessor 119.

The speed control circuit 99 compensates for variations in the ambient temperature. The temperature sensor 131 is mounted in the pump housing (it may be mounted in one of the parts 46 and 58) and senses the temperature of the pump. As the ambient temperature increases, the vapor expands, and the pumping equipment also has a tendency to shift slightly in performance and thereby increase the potential for drift. The microprocessor 119 automatically increases the speed of the motor-pump and, thereby, the rate of vacuum, to compensate for the increase in the temperature. The microprocessor 119 includes an algorithm which in response to a temperature change, modifies the motor speed to maintain a predetermined pump flow characteristic needed to maintain the efficiency of the vapor recovery system. The microprocessor 119 also responds to an excessively high temperature condition (which may be the result of a malfunction) and it adjusts the motor speed (it may speed up the motor, slow down the motor or stop the motor entirely). In addition, the microprocessor responds to a decreasing temperature by reducing the motor-pump speed to slow the rate of vacuum to a level that matches the rate of fuel flow. The microprocessor also responds to an excessively cold temperature to prevent the motor-pump from freezing by running the motor at a slow speed when fuel is not being pumped and/or injecting a DC current component into the motor winding or providing a higher motor voltage in order to heat the windings and the remainder of the motor-pump.

The microprocessor 119 further functions to produce a substantially linear relationship between the commanded motor-pump speed and the pump vapor flow rate. This relationship may tend to be nonlinear due to factors such as pump leakage, bearing friction, vacuum level and motor slip (in an induction motor). Nonlinearity causes significant variations in the effective recovery of vapor as the fuel flow rate changes. For example, a vapor recovery system which is 95% efficient in vapor recovery at a fuel flow rate of ten gallons per minute (gpm) may be only 60% efficient at one gpm. In the present invention, the microprocessor 119 is programmed to produce a linear relation. The operating characteristics of the motor 39, the pump 38 and other system parameters are known, and for each value of the flow meter 30 signal, the microprocessor 119 algorithmically determines the appropriate electrical frequency for powering the motor 39 to produce a linear response of the motor.

The system further provides for calibration in order to adjust the relationship between the speed command signal (the signals from the fuel flow meter) and the output motor speed needed to produce the required flow rate of the vapor. For example, changes in dispenser hose and/or nozzle may change the vapor flow; the present system may be calibrated before installation (assuming a given set of operating parameters) or at any time after installation in a dispenser. A calibration signal on the input 133 is fed to the microprocessor 119 to alter the relationship between the vapor flow rate and the fuel flow rate. Once calibration has been achieved, the microprocessor 119 stores the calibration information in an electrically erasable read only memory (EEROM), which provides for storage even though power may be removed from the system.

Calibration is accomplished by adjusting the algorithm, in the processor 119, which controls the electrical motor frequency. While the calibration signal may take various forms, such as digital or analog signals, in the present instance a PWM signal is employed. As a specific example, depending upon the duty cycle of the calibration signal on the input 133, the motor speed may be increased or decreased.

The performance of the motor 39 and the pump 38 is also monitored, and an error signal is produced on the line 142 in the event the operation is outside preset limits. The electrical signals on the lines 111 and 113 are representative of the DC link voltage and the DC link current, and these two values are multiplied in the microprocessor 119 to produce a value of the DC link power delivered to the motor. The magnitude of the DC link power is a measure of the motor load. The motor load may become excessive during operation for various reasons, such as a restricted or blocked vapor intake or vapor conduit, a stuck vapor valve, or a failed motor bearing. The operating power level of the DC link has an acceptable range based on system performance, and this range changes with the motor-pump speed. Consequently, the microprocessor 119 receives both the value of the DC link power and the commanded electrical speed of the motor 39. Stored in the microprocessor 119, for each commanded motor speed, is an acceptable or permissible range of DC link power. Since the motor type and the pump type are known, the power is mapped, versus commanded speed, over the full range of operating speeds. If, at a given commanded speed, the DC link power falls outside the acceptable range, an error signal is generated by the microprocessor 119. The error signal appears on the error line 142 and may be utilized in a variety of ways, such as to energize a fault signal in a control panel. The microprocessor may also be programmed to disable the motor 39 if a fault signal is generated a preset number of times during a given period of time. Further, the microprocessor is preferably programmed to allow the motor to restart after a preset period of time. In this manner, the unit responds both to the commanded motor speed and to the DC link power level; if, for example, the vapor intake is totally or partially blocked by liquid fuel, the system senses an overload and the motor may be turned off if the blockage persists for a period of time, but the unit resets and allows the motor to restart after a timing period of a few minutes. Instead, the processor may be programmed to shut down permanently or temporarily, or for the duration of the fuel dispensing cycle.

The construction and operation of the control package will be better understood from the flow chart shown in FIGS. 8A to 8F. The variable frequency square wave signal or signals on the lines 117 and/or 118 are converted by the $\mu$p 119 to digital signals (see blocks 151 and 152 of FIG. 8A). In the present specific example, each digital signal comprises a 15 bit digital word, but it should be understood that accuracy is not limited to 15 bits. If signals are received simultaneously from both lines 117 and 118 (in other words, two fuel flow rate signals), the $\mu$p totals the two signals (block 153) to form a 16 bit word designated $F_T$. While two fuel flow rate signals P1 and P2 are shown, more than two flow rate signals may be received and totaled. In any event, $F_T$ represents the total flow of fuel. The two flow rate signals, in this example, are demodulated and totaled by the $\mu$p software.

Figure 8A:
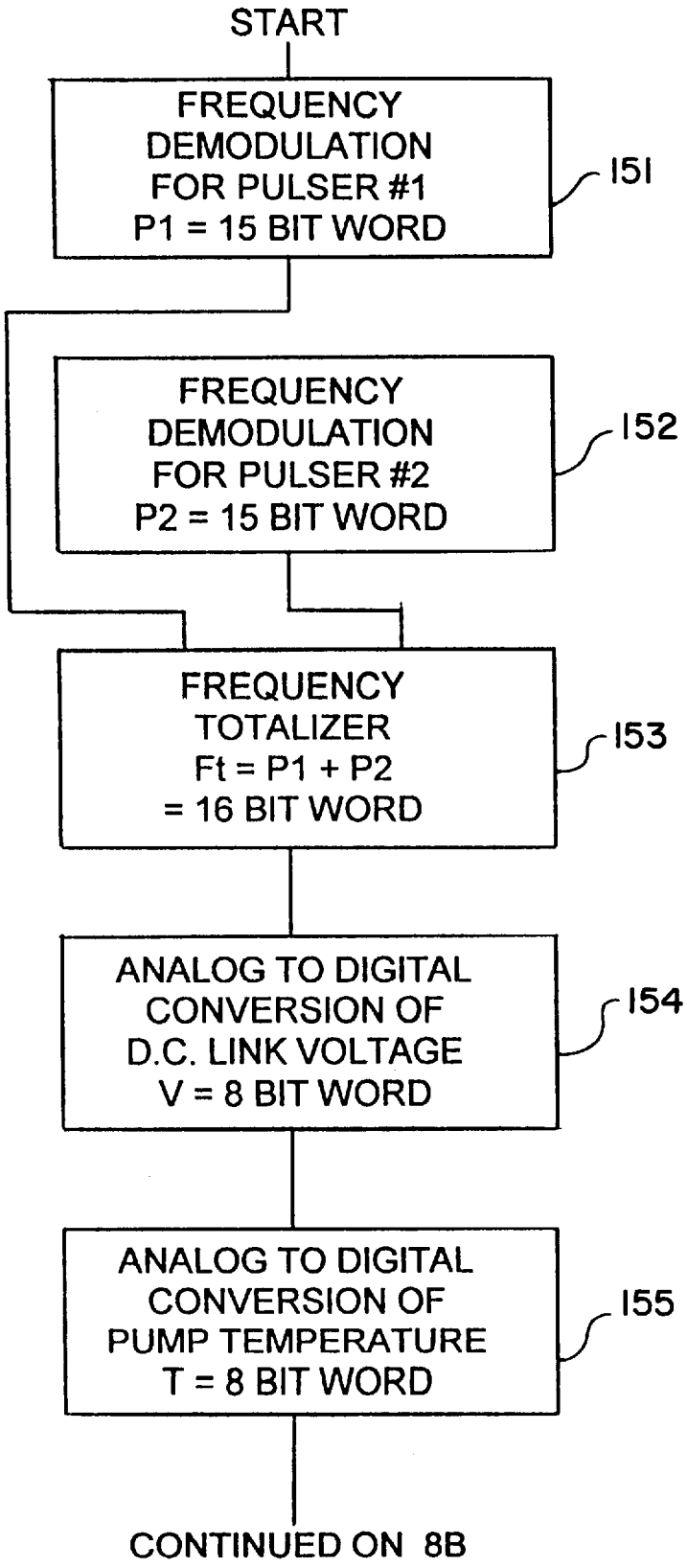
FIGS. 8A to 8F show a flow chart illustrating the operation of the control package.
Figure 8B:
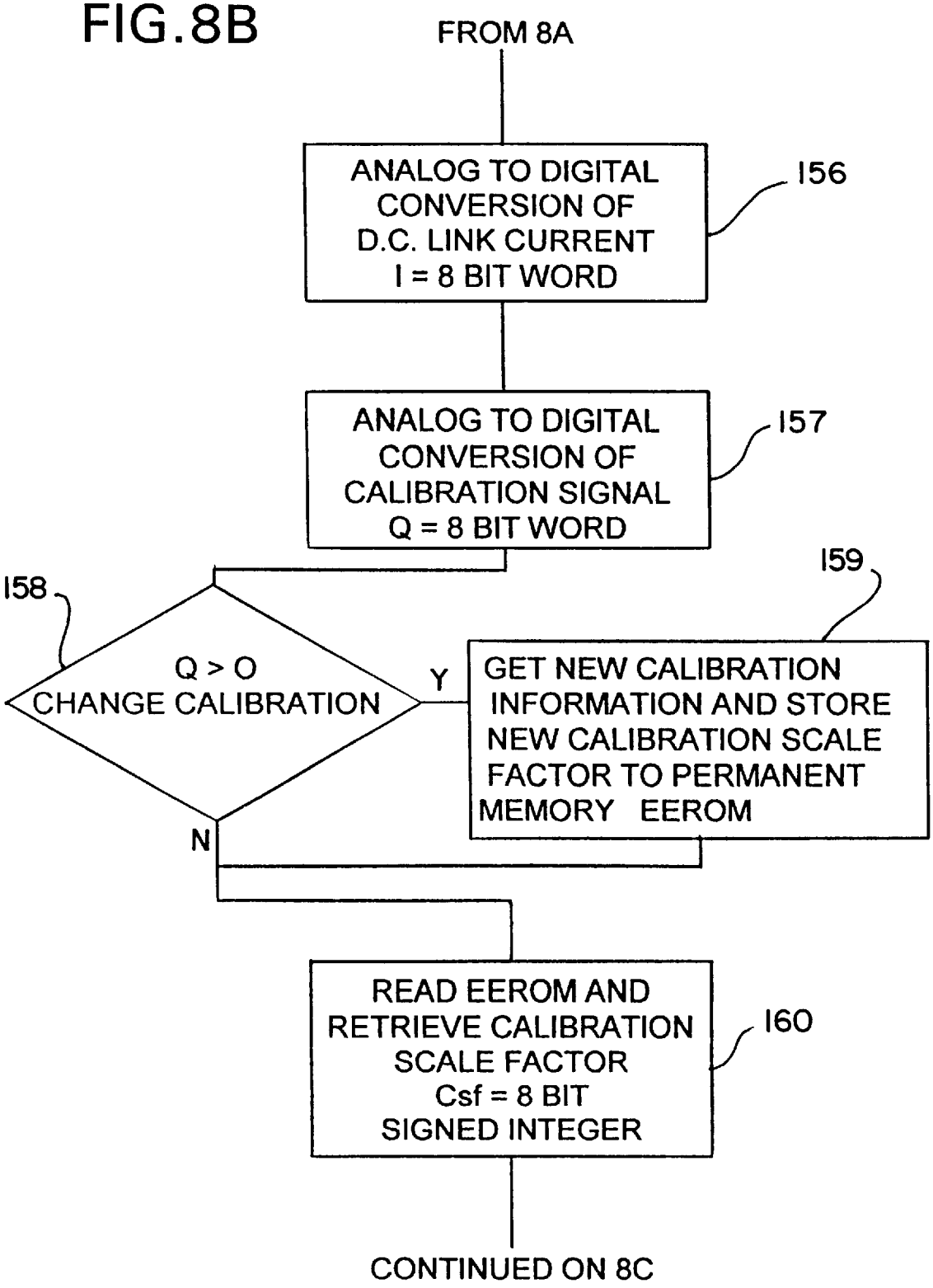

The analog to digital conversion of the DC link voltage and current on lines 111 and 113, and the conversion of the pump temperature, is performed in the converter 114 (see blocks 154, 155 and 156 of FIGS. 8A and 8B). In block 157, a calibration signal on line 134 is also converted to a digital signal, and the calibration function will be discussed in more detail hereinafter in connection with blocks 157 to 160. In this specific example, each input signal is converted to an 8 bit digital word by the converter 114.

While the fuel flow rate signals on the lines 117 and 118 change linearly with the fuel flow rates (and the signal $F_T$ also changes linearly with the total flow rate), and while the drive to the motor 39 may be made to change linearly with the total fuel flow rate, the vapor flow rate (the volume of vapor moved by the pump 38) may not change linearly with the fuel flow rate and the commanded motor speed. This nonlinearity may result from one or more factors such as motor slip (in the case of an induction motor), changes in the pump efficiency with changes in the rate of fuel delivery, the fuel dispenser pressure operating level, the plumbing of the fuel dispenser, and the fuel flow rate signal generator. However, for a given type of given type of motor 39 and pump 38, and for a typical operating environment, the nonlinearity may be determined. In accordance with this invention, the amounts of nonlinearity for a range of total fuel flow rates are measured, and linearity scaling factors are stored in a memory of the $\mu$p 119. The $\mu$p 119 and the motor control 123 read the scaling factor in a software look-up table at a given total fuel flow rate, and adjust or modify the operation of the driver circuit 126 to obtain an essentially linear relation between the total fuel flow rate and the vapor flow rate.

Figure 8C:
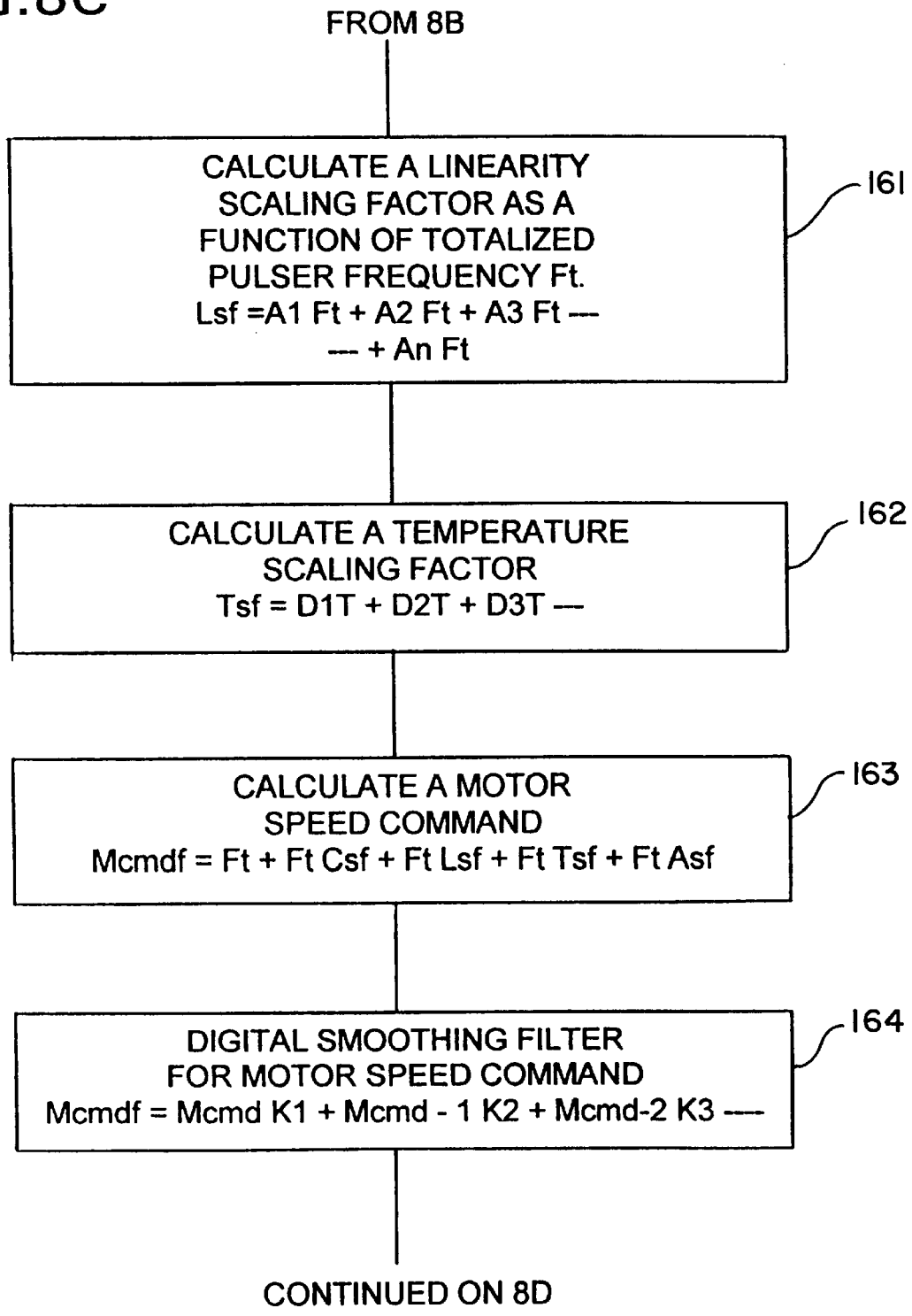

With reference to FIGS. 8B and 8C, blocks 160 to 163 show that a number of scaling factors are stored and combined to produce a motor speed command signal $M_{CMD}$. In block 160, a calibration scaling factor $C_{SF}$ is retrieved from permanent memory EEROM. The calibration function will be discussed hereafter. In block 161, a linearity scaling factor $L_{SF}$ (discussed above) is calculated and stored. The coefficients $A_1$, $A_2$, $A_3$, etc. are derived from the characteristics of the type or style of the motor 39, the pump 38 and the operating environment. Scaling factors over a range of total fuel flow rates are measured or calculated, stored and retrieved from a software look-up table. The scaling factor at a given flow rate may be calculated in the $\mu$p 119 or retrieved from the table.

While the coefficients $A_1$, $A_2$, etc. may be fixed values, they may instead be dynamic and variable as a function of a system function or characteristic such as the DC link power or a variable such as the inlet vapor pump pressure. For example, $A_1$ may be calculated as a function of pressure P as follows: $A_1=B_1P+B_2P^2+B_3P^3$ - - - .

In block 162, a scaling factor $T_{SF}$ is calculated or retrieved from a table. This scaling factor is derived from the pump temperature sensor 131, and temperature scaling factors over a range of expected temperatures are stored, similar to the scaling factors for linearity as discussed above. The temperature scaling factor compensates for changes in pumping efficiency with temperature changes.

In block 163, a motor speed command signal $M_{CMD}$ is calculated based on the total fuel flow signal $F_T$, the calibration scaling factor $C_{SF}$, the linearity scaling factor $L_{SF}$, the temperature scaling factor $T_{SF}$ and any application scaling factor $A_{SF}$. The application scaling factor is dependent upon the frequency of the total fuel flow rate signal and it scales the signal to be acceptable for use by the motor control ASIC 123.

Block 164 shows a digital smoothing filter which is preferably provided. The digital smoothing filter coefficients $K_1$, $K_2$, $K_3$ - - - $K_n$ are chosen (by well known technology) to provide optimal performance for the vapor recovery system and are system coefficients. The number of K coefficients determines the order of the digital filter and may be thought of as analogous to the number of poles in an analog filter. The notation $M_{CMD}$-1 in block 164 indicates the motor command one time period earlier, the notation a $M_{CMD}$-2 indicates the motor command two time periods earlier, etc.

The digital filter is preferably provided in the present vapor recovery system because it defines the response of the vapor pump flow to the fuel flow rate pulser frequency. Further, the above-mentioned filter coefficients may be changed on a dynamic basis whereby the system response may be based on the detection of changes in pertinent system conditions. Such an adaptive filter or control adjusts the system response on its own as a function of time and/or pressure and/or temperature, etc.

Figure 8D:
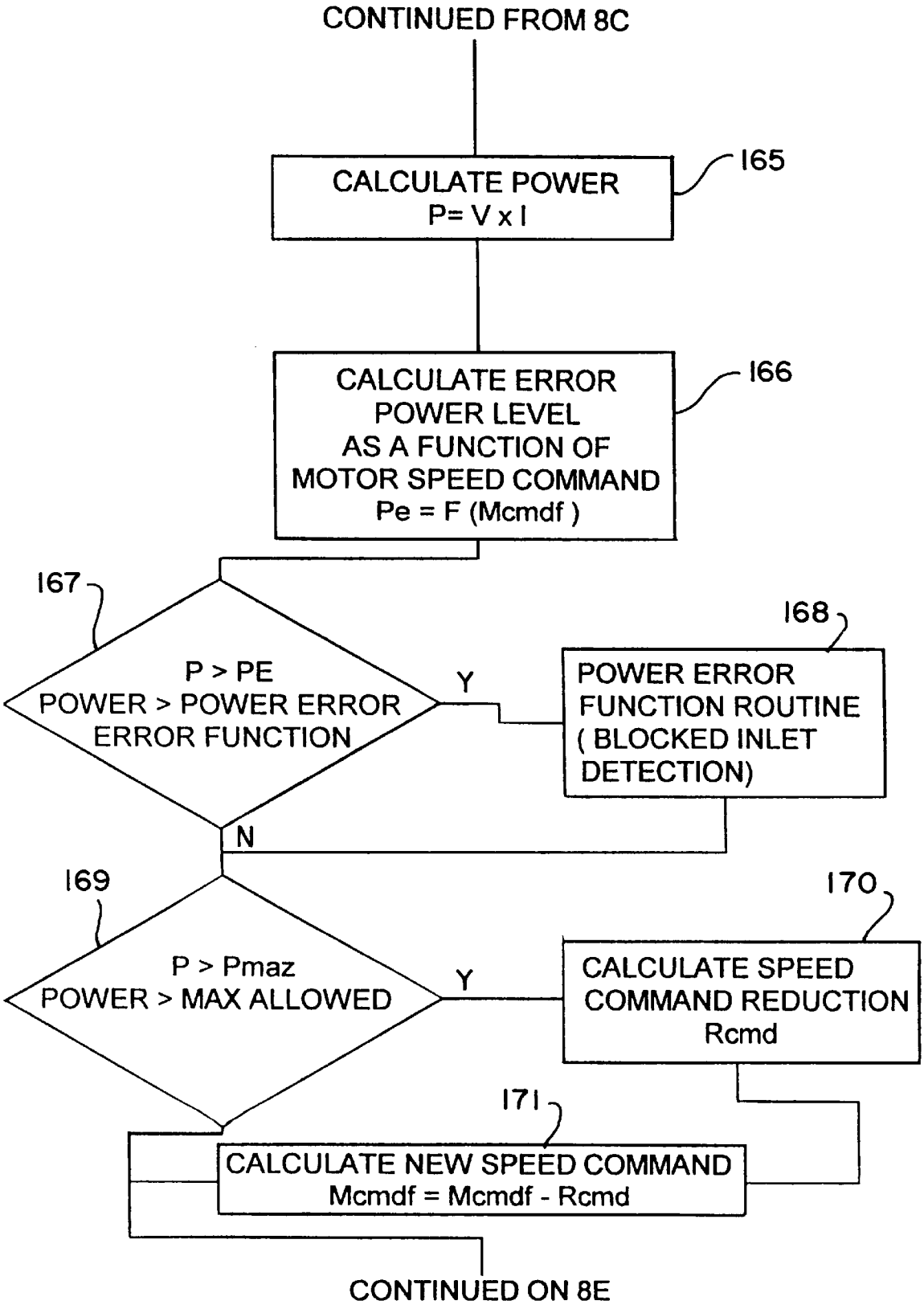
Figure 8E:
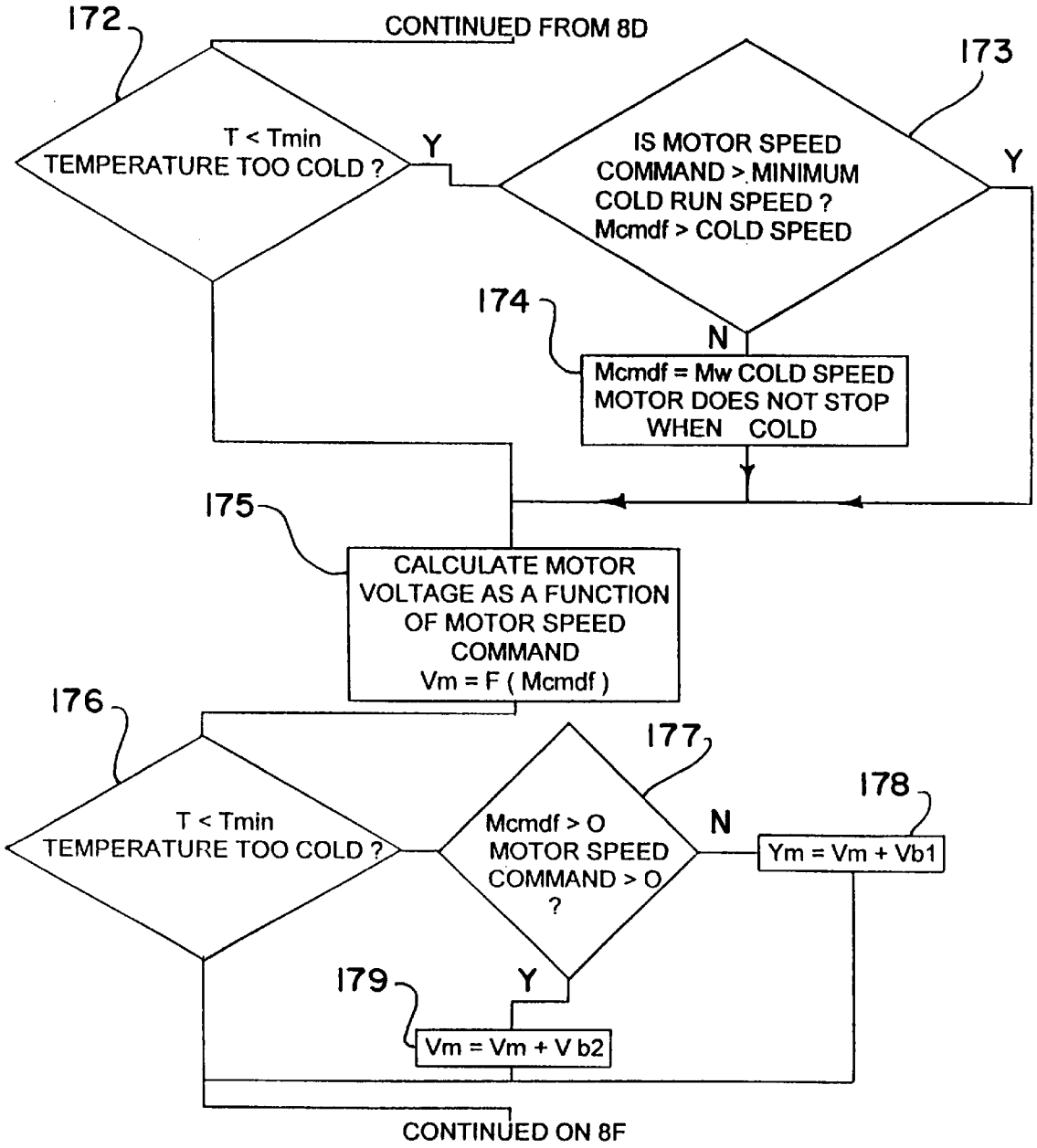
Figure 8F:
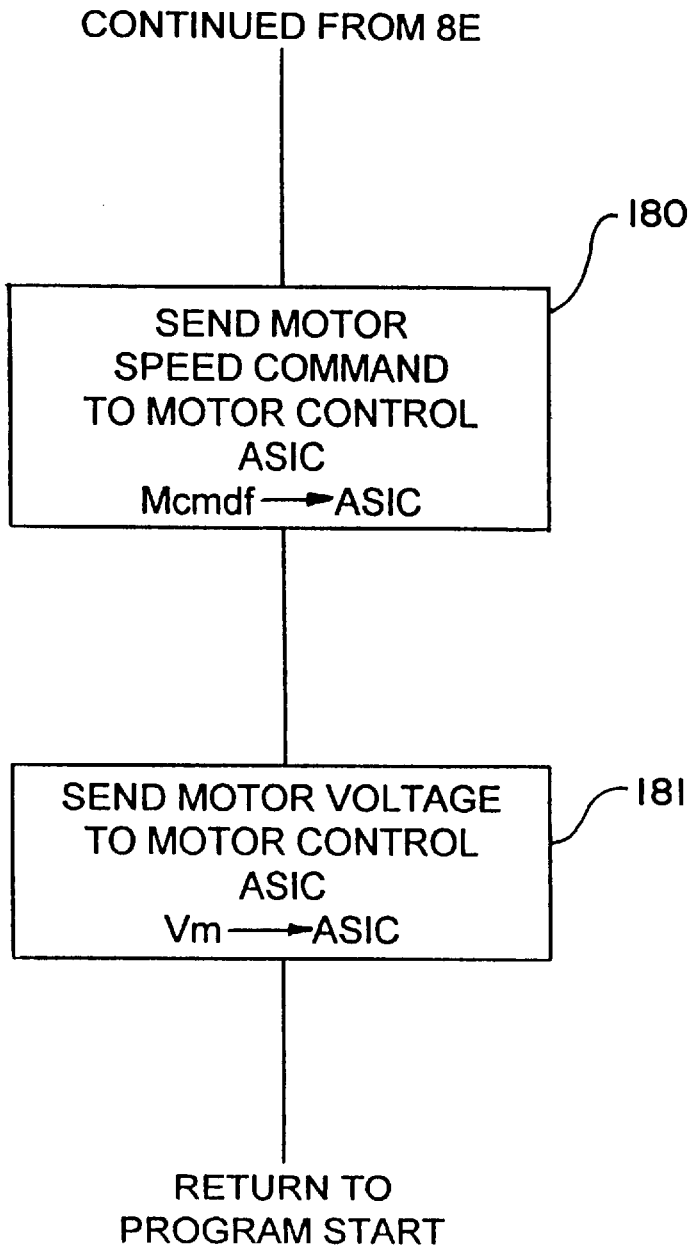

With reference to FIG. 8D, blocks 165 to 171 perform a fault condition detector. The $\mu$p 119 receives the DC link voltage and current values from the converter 114, and the power P is calculated in block 165. The $\mu$p 119 also receives the motor speed command signal from the motor control 123, and the error power level $P_E$ at the commanded motor speed is calculated or retrieved from a look-up table in the memory of the $\mu$p 119. If the measured power is greater than the calculated power (block 167), this may be an indication of a blocked vapor pump inlet or outlet. The block 168 receives a power error signal if the measured power is excessive, and if the power error signal persists for a preset period of time, the $\mu$p 119 generates an error signal on the lines 141 and 142 (FIG. 7). The error signal from the output circuit 138 may be utilized in various ways, such as by flashing a signal at a central control console in a service station. The block 168 may be programmed to generate an error signal only if fault conditions occur a certain number of times within a preset time period. This feature is a significant improvement over prior art systems which include a circuit breaker that detects an abnormal operating condition and then shuts down the system, because the present invention allows the system to run for a time to enable a fault to clear itself. Further, in accordance with this invention, the power error signal $P_E$ is a function of the motor speed command signal $M_{CMDF}$. Therefore the magnitude of a fault condition needed to generate an error signal increases with motor speed, and the present system is able to detect low speed faults which may not be detected by other systems.

Blocks 169, 170 and 171 (FIG. 8D) also respond to the motor power level in the D.C. link. In block 169, the measured power level P is compared with a preset maximum value $P_E$ and if the measured power level is greater than the preset level, the motor speed is reduced slightly by the operation of the blocks 170 and 171. In the present specific example, the means for reducing the motor speed in the blocks 170 and 171 comprises a calculation of a speed reduction command signal $R_{CMD}$ from the equation $$R_{CMD}=(P-P_{MAX})G_1+G_2\int(P-P_{MAX})\partial t+G_3\partial(P-P_{MAX})/\partial t,$$

where $(P-P_{MAX})$ is the excess or error power amount. In block 171, the speed reduction signal $R_{CMD}$ is subtracted from the prior motor speed command signal $M_{CMDF}$ to produce a new reduced motor speed command signal. It will be apparent that the amount of the speed reduction is proportional to the error plus an amount proportional to the integral of the error plus an amount proportional to the derivative of the error. While the above specific example comprises a speed reduction based on three error components, it may instead be acceptable to base the reduction on only one or two error components.

In blocks 172, 173 and 174 (FIG. 8E), the pump temperature from sensor 131 is compared in block 172 to a preset temperature value such as the minimum cold operating temperature for the pump-motor. If the measured temperature T is less than the preset minimum temperature $T_{MIN}$, the block 173 compares the motor speed command signal $M_{CMDF}$ with a preset minimum cold speed. If $M_{CMDF}$ is above the minimum cold speed, then the operation continues to block 175. However, if $M_{CMDF}$ is less than the preset minimum cold run speed command, the block 174 adjusts the $M_{CMDF}$ to make it equal to the preset minimum cold run speed command.

The motor 39 is preferably an induction motor for reliability. When using a variable speed induction motor with a DC link drive as described herein, the ratio of the voltage applied to the motor and the applied frequency is typically held constant. At the least, the voltage applied to the motor needs to be reduced as the speed of the motor is reduced. In block 175, the voltage $V_M$ to the motor is calculated and varied as a function of the motor speed command signal f ($M_{CMDF}$). While this function may be accomplished by providing a "look-up table" in the memory, wherein the desired motor voltages for a range of motor speeds is stored, the voltage may also be calculated from $V_M$=K speed command now/Maximum speed command, wherein K is a constant The voltage value may also be scaled to account for variations in the power line voltage, such as $$VM = VM1 \frac{\text{DC link voltage desired}}{\text{DC link voltage now}}$$

The blocks 176, 177, 178 and 179 are preferably provided to prevent icing of the pump-motor unit by keeping the unit temperature above a certain value. In block 176, the pump temperature T derived from the sensor 131 is compared with a preset minimum temperature value $T_{MIN}$. If the sensed temperature T is below the minimum value, block 177 checks the motor speed command $M_{CMDF}$ to see whether it is greater than zero. If the motor speed is not greater than zero, block 178 increases the motor voltage $V_M$ by a constant $V_{B1}$. At zero motor speed, the motor voltage is normally zero; by providing the DC voltage $V_{B1}$ through the motor windings, the resistance heat from the windings prevents the motor-pump temperature from falling below the preset value $T_{MIN}$.

If the motor command speed $M_{CMDF}$ is above zero and the temperature is low, the block 179 increases the motor voltage $V_M$ by an amount $V_{B2}$ which is sufficient to heat the pump-motor unit.

The blocks 176 to 179 may be provided and used instead of or in conjunction with the blocks 172 to 174. of course, either may be used alone. The above-described temperature increasing functions serve to prevent icing and may also serve to prevent the pump parts from binding due to thermal contraction.

In blocks 180 and 181, the motor speed command signal and the motor voltage control signal are sent to the control unit 123.

As previously mentioned, the blocks 158, 159 and 160 perform a calibration function. As shown in FIG. 7, a calibration signal is received on lines 133 and 141, and it is converted to a digital word in the block 157. It is an important feature of this invention that calibration may be performed by a single electrical signal at one input. A calibration input signal is read and interpreted by the $\mu$p 119, and if needed, changes a scaling factor $C_{SF}$ which alters the relationship between the vapor pump flow volume and the dispensed fuel flow volume. The $\mu$p stores the calibration information in an EEROM (electrically erasable read only memory) which allows for permanent storage of the calibration information even in the absence of power.

While the calibration information may be digital or analog, in the present specific example of the invention, a pulse width modulated (PWM) signal is used to change the calibration scaling factor. In this example, a constant frequency (such as 1000 hertz) PWM square wave pulse train is provided on the lines 133 and 134, and the duty cycle is varied to change the scaling factor which in turn operates to increase or decrease the motor speed.

Thus, the unit may be calibrated by a single electrical signal, thereby avoiding the need for an adjustable potentiometer or other mechanical or electrical device. Further, the unit may be calibrated after installation in a dispenser or before installation if the operating conditions are known.

What is claimed is:

1. A unitary motor-pump-control unit for recovering vaporized fuel, comprising:

a) an explosion-proof housing which is mountable to a fuel dispensing cabinet;

b) a pump portion, a motor portion and a control portion within said explosion-proof housing;

c) a pump mounted in said pump portion;

d) a fuel vapor inlet opening and a fuel vapor outlet opening in said pump portion;

e) an electric motor mounted in said motor portion and coupled, within said explosion-proof housing, to drive said pump;

f) a control package mounted in said control portion of said explosion-proof housing and electrically connected to said motor for controlling energization of said motor, said control package including a control circuit for varying the speed of said motor; and g) sealing means in said housing between said motor portion and said pump portion for vapor isolating said motor from said pump.

2. A unitary motor-pump-control unit as set forth in claim 1, wherein said pump comprises a positive displacement pump for pumping vapor.

3. A unitary motor-pump-control unit as set forth in claim 1, wherein said control portion includes an opening for passage of electrical conductors.

4. A unitary motor-pump-control unit as set forth in claim 1, wherein said pump comprises a positive displacement type, said motor comprises a variable speed induction motor, and said control means comprises a DC link producing a variable frequency power output.

5. The unitary motor-pump-control unit of claim 1 wherein said electric motor comprises an induction a.c. motor.

6. A unitary motor-pump-control unit, comprising an explosion-proof housing, first and second end plates within said housing, an electric motor supported by said end plates and mounted between first sides of said end plates, a pump mounted within said housing on a second side of said first end plate, an electrical control package comprising a speed control circuit for continuously varying the speed of said motor mounted within said explosion-proof housing on a second side of said second end plate, said first end plate having a first opening therein, a drive coupling extending through said first opening and connecting said motor and said pump, a seal between said first end plate and said drive coupling, said second end plate having a second opening therein, and electrical connectors extending through said second opening and connecting said electrical control package with said motor.

7. A unitary motor-pump-control unit as set forth in claim 6, wherein said motor comprises a motor shell clamped between said first and second end plates, said pump comprises a pump cover fastened to said first end plate and having inlet and outlet openings therein, and a control package cover fastened to said second end plate.

8. Apparatus for use in a vapor recovery system of a fuel dispenser, the fuel dispenser including a fuel dispensing cabinet, means for delivering fuel from a fuel storage container through a delivery pipe to a fuel tank, fuel meter means for measuring the volume of fuel flowing through said delivery pipe and for providing an electrical signal representative of said volume of fuel, the vapor recovery system including a vapor return tube for recovering vapor from the fuel tank, said apparatus comprising:

a) a pump having a fuel vapor inlet for connection to said vapor return tube;

b) a variable speed electric motor coupled to said pump for driving said pump;

c) a control package having a terminal for receiving said electrical signal, said control package comprising a speed control circuit connected to said motor for powering said motor at a speed such that the volume of vapor moved through said pump is proportional to the volume of fuel measured by said fuel meter means; and d) a unitary, explosion-proof housing adapted for being mounted to the fuel dispensing cabinet containing said pump, said electric motor and said control package.

9. Apparatus as set forth in claim 8, wherein said control package comprises a rectifier for converting AC power to DC power, an inverter for converting said DC power to variable frequency power for driving said variable speed electric motor, and said speed control circuit is electrically connected to said inverter for controlling said variable frequency power, said speed control circuit being also electrically connected to said terminal for receiving said electric signal.

10. Apparatus as set forth in claim 9, wherein said fuel dispenser system includes a second fuel meter means for providing a second electrical signal representative of the volume of fuel through a second delivery pipe, said speed control circuit further being connected to receive said second electrical signal and to control said variable frequency power according to the sum of said electrical signals.

11. A vapor return system for a fuel dispenser, the fuel dispenser including a fuel conduit for delivering fuel to a fuel tank and a fuel flow meter connected to the fuel conduit for providing a fuel signal representative of the rate of fuel flow through the fuel conduit, said vapor return system comprising:

a) a vapor return conduit having an aperture for communication with said fuel tank for conveying vapor displaced by fuel from the fuel conduit;

b) a vapor pump connected in said vapor return conduit, and a variable speed electric motor coupled to drive said vapor pump; and c) an electrical control connected to said electric motor for powering said electric motor at variable speeds, said electrical control comprising a DC link driving a variable frequency inverter, sensor means connected to said DC link for sensing the DC link power delivered to said inverter and motor, and processor means responsive to said fuel signal and connected to said inverter and producing a frequency command signal for said inverter, said processor means further being responsive to said sensor means and to said frequency command signal and producing an error signal when said DC link power is excessive at a value of said frequency command signal.

12. A vapor return system as set forth in claim 11, wherein said processor means has stored therein a map of acceptable DC link power levels over a range of frequency command signals, and said error signal is produced when said DC link power is outside of said acceptable DC link power level at a given frequency command signal.

13. A vapor return system as set forth in claim 11, wherein said DC link includes a rectifier, an inverter, and conductors between said rectifier and said inverter, and said sensor means is connected to said conductors and senses the voltage and current in said conductors.

14. The vapor return system of claim 11 further including:

a calibration signal electrically connected to said processor means for controlling the speed of the vapor pump electric motor in relation to the fuel flow signal, whereby the ratio of fuel vapor flow through the vapor return conduit and fuel flow through the fuel conduit is constant.

15. The vapor return system of claim 14 wherein said calibration signal comprises an electrically erasible read only memory device (EEROM) for storing calibration information.

16. A vapor return system for a fuel dispenser, the fuel dispenser including a fuel conduit for delivering fuel to a fuel tank and a fuel flow meter connected to the fuel conduit for providing a fuel signal representative of the rate of fuel flow through the fuel conduit, said vapor return system comprising:

a) a vapor return conduit having an aperture for communication with said fuel tank for conveying vapor displaced by fuel from the fuel conduit;

b) a vapor pump connected in said vapor return conduit, and a variable speed electric motor coupled to drive said vapor pump;

c) a temperature sensor connected to said vapor pump for producing a temperature signal representative of the temperature of said vapor pump; and d) an electrical control connected to said electric motor for powering said electric motor at variable speeds, said electrical control comprising processor means having an electrical terminal for connection to said fuel signal, said processor means responsive to said fuel signal for producing a motor speed command signal which is related to the rate of fuel flow through said fuel conduit, said processor means further being responsive to said temperature signal for adjusting said motor speed command signal and continuously varying the speed of said motor according to the temperature changes of said vapor pump for flow compensation.

17. A vapor return system as set forth in claim 16, wherein said processor means adjusts said motor speed command signal as said temperature signal indicates a change in the temperature of said vapor pump.

18. A vapor return system for a fuel dispenser, the fuel dispenser including a fuel dispensing cabinet, a fuel conduit for delivering fuel to a fuel tank and a fuel flow meter connected to the fuel conduit for providing a fuel signal representative of the rate of fuel flow through the fuel conduit, said vapor return system comprising:

a) a vapor return conduit having an aperture for communication with said fuel tank for conveying vapor displaced by fuel from the fuel conduit;

b) a vapor pump connected in said vapor return conduit, and a variable speed electric motor coupled to drive said vapor pump;

c) an electrical control connected to said electric motor for powering said electric motor at variable speeds, said electrical control including an electrical terminal for connection to said fuel signal, and processor means responsive to said fuel signal for producing a motor speed command signal for powering said electric motor at a speed which is linearly proportional to said rate of fuel flow through said fuel conduit, and d) a unitary, explosion-proof housing adapted for being mounted to the fuel dispensing cabinet containing said vapor pump, said electric motor and said electrical control.

19. The vapor return system of claim 18, further including a low temperature compensation control circuit comprising:

a pump temperature sensor electrically connected to said vapor pump for producing a temperature signal; and means responsive to said temperature signal for running said motor at a minimum speed when said temperature is below a predetermined value to avoid pump lockup due to icing while said dispenser is inactive.

20. The vapor return system of claim 18 wherein said variable speed electric motor comprises a stator and a rotor, each having motor windings, further including a low temperature compensation control circuit comprising:

a pump temperature sensor electrically connected to said vapor pump for producing a temperature signal; and means responsive to said temperature signal for applying a d.c. current to a motor winding when said temperature is below a predetermined value to avoid pump lockup due to icing while said dispenser is inactive.

21. A vapor return system for a fuel dispenser, the fuel dispenser including a fuel dispensing cabinet, a fuel conduit for delivering fuel to a fuel tank and a fuel flow meter connected to the fuel conduit for providing a fuel signal representative of the rate of fuel flow through the fuel conduit, said vapor return system comprising:

a) a vapor return conduit having an aperture for communication with said fuel tank for conveying vapor displaced by fuel from the fuel conduit;

b) a vapor pump connected in said vapor return conduit, and a variable speed electric motor coupled to drive said vapor pump;

c) an electrical control connected to said electric motor for powering said electric motor at variable speeds, said electrical control including an electrical terminal for connection to said fuel signal, and processor means for producing a motor speed command signal for controlling the speed of said electric motor, said processor means including calibration means for adjusting said motor speed command signal to produce a vapor flow rate which is substantially equal to said rate of fuel flow; and d) a unitary, explosion-proof housing adapted for being mounted to the fuel dispensing cabinet containing said vapor pump, said electric motor and said electrical control.

22. A vapor return system as set forth in claim 21, wherein said calibration means is responsive to a calibration signal which is modulated, and said calibration means is responsive to said modulation to adjust said motor speed command signal.

23. A vapor return system as set forth in claim 22, wherein said calibration signal is pulse-width-modulated.

24. A dispenser for delivering fuel into a motor vehicle fuel tank comprising:

a) a pair of fuel conduits in said dispenser, each of said conduits connected to a fuel flow meter providing fuel signals representative of the rates of fuel flow through the two fuel conduits;

b) a vapor return conduit in said dispenser, said conduit having an aperture for communication with the vehicle fuel tank for conveying vapor displaced by fuel from the two fuel conduits;

c) a vapor pump connected in said vapor return conduit, and a variable speed electric motor coupled to drive said vapor pump;

d) an electrical control connected to said electric motor for powering said electric motor at variable speeds, said electrical control comprising processor means responsive to said two fuel signals for combining said two fuel signals and for powering said electric motor at a speed which is related to the rates of fuel flow through the two fuel conduits;

e) a fuel dispensing cabinet; and f) a unitary, explosion-proof housing mounted to the fuel dispensing cabinet containing said vapor pump, said electric motor and said electrical control.

25. A dispenser as set forth in claim 24, wherein said electric motor comprises an induction motor, and said electrical control comprises a DC link having a variable frequency power output connected to said electric motor, a motor control connected to said DC link for controlling the frequency of said power output, and said processor means being connected to said motor control for adjusting said motor control to power said electric motor at said speed which is related to said fuel flow rates.

* * * * *